United States Patent [19]

Morris, II et al.

[11] Patent Number: 4,613,040

[45] Date of Patent: Sep. 23, 1986

[54] FOLDING CASE

[75] Inventors: Robert L. Morris, II, Manchester Center, Vt.; Franklin C. Nichols, Dallas, Tex.

[73] Assignee: Pente Games, Inc., Stillwater, Okla.

[21] Appl. No.: 596,834

[22] Filed: Apr. 4, 1984

[51] Int. Cl.[4] ..... B65D 6/00; B65D 43/14

[52] U.S. Cl. ..... 206/315.1; 206/472; 16/115; 220/334; 220/339; 273/285; 402/77

[58] Field of Search ..... 16/110.5, 115, 223, 16/225, 270, 365, 366, 372; 190/100, 114, 115; 206/315.1, 387, 472, 494, 579; 281/21 A, 25 A, 25 R; 402/73-78, 70, 502; 220/334, 338, 339, 342, 343; 273/285

[56] References Cited

U.S. PATENT DOCUMENTS

| | | | |
|---|---|---|---|
| D. 34,457 | 4/1901 | Neitzel . | |
| D. 96,907 | 9/1935 | Drake . | |
| 166,776 | 8/1875 | Herzog . | |
| D. 167,382 | 7/1952 | Wales | D34/5 |
| 174,958 | 3/1876 | Homrighausen . | |
| D. 186,234 | 9/1959 | Parnell, Jr. | D34/5 |
| D. 204,277 | 4/1966 | Neal | D34/5 |
| D. 223,845 | 6/1972 | Roberson | D21/1 |
| D. 226,570 | 3/1973 | Neece | D34/5 SS |
| D. 256,594 | 8/1980 | Tawil | D21/15 |
| 299,272 | 5/1884 | Schmickl . | |
| 328,342 | 10/1885 | Robinson . | |
| 374,325 | 12/1887 | Roemer . | |
| 398,540 | 2/1889 | Roemer . | |
| 486,952 | 11/1892 | Gillespie . | |
| 752,756 | 2/1904 | Christie . | |
| 864,066 | 8/1907 | Berwick . | |
| 941,040 | 11/1909 | Petri . | |

(List continued on next page.)

FOREIGN PATENT DOCUMENTS

| | | | |
|---|---|---|---|
| 0033918A | 8/1981 | European Pat. Off. | 273/285 |
| 0829043 | 1/1952 | Fed. Rep. of Germany | 190/115 |
| 327957 | 4/1930 | United Kingdom . | |
| 1252809 | 11/1971 | United Kingdom . | |
| 1436453 | 5/1976 | United Kingdom . | |
| 1588570 | 4/1981 | United Kingdom . | |

OTHER PUBLICATIONS

Drawings and Abstract, West German Pat. No. 2,027,148, published Dec. 1971.

*Primary Examiner*—William Price
*Assistant Examiner*—Jimmy G. Foster
*Attorney, Agent, or Firm*—Dunlap, Codding & Peterson

[57] ABSTRACT

A case having two relatively pivotable, open ended case sections that abut at the open ends when the case is in an open position to form a walled, open-positioned to form a walled, open-topped enclosure, the case having a closed position in which the floors in the two sections are disposed parallel and the walls of the case sections extend about three sides of the region between the floors of the case sections. The case further includes a closure panel having a laminar central portion which is moved into recesses in the floors of the case sections when the case is opened so as to avoid forming a blockage between the floors of the two case sections in the open position and which is moved to a position to close the fourth side of the case in the closed position. The movement of the closure panel is effected by providing the closure panel with upturned end portions, each end portion having a pair of lugs extending therefrom toward the walls of the case sections, and providing the walls of the case sections with sockets to receive the lugs, one lug at each end of the closure panel being disposed in a socket formed in the wall of one case section and the other lug being disposed in a socket formed in the wall of the other case section. The lugs and sockets are sized and positioned so that a line between centers of the lugs will parallel a line between centers of sockets in either position and the line between centers of the sockets parallels the floors of the case sections in the open position of the case and extends perpendicularly to the floors of the case sections in the closed position of the case.

20 Claims, 27 Drawing Figures

U.S. PATENT DOCUMENTS

| | | | |
|---|---|---|---|
| 1,262,821 | 4/1918 | Marks . | |
| 1,292,498 | 1/1919 | Logan . | |
| 1,325,164 | 12/1919 | Mowrey . | |
| 1,430,778 | 10/1922 | Williams . | |
| 1,438,244 | 12/1922 | Kahlow . | |
| 1,441,386 | 1/1923 | Truskoski . | |
| 1,458,798 | 6/1923 | Bethke et al. . | |
| 1,460,016 | 6/1923 | Emery . | |
| 1,505,593 | 8/1924 | Fryer . | |
| 1,579,276 | 4/1926 | Birnberg | 206/315.1 |
| 1,689,664 | 10/1928 | Covell . | |
| 1,771,008 | 7/1930 | Reinhardt . | |
| 1,859,052 | 5/1932 | Ritter, Jr. . | |
| 1,896,881 | 2/1933 | Cooper | 402/77 |
| 1,985,521 | 12/1934 | Schell . | |
| 2,078,383 | 4/1937 | Herzog . | |
| 2,104,568 | 1/1938 | McClure | 402/77 |
| 2,157,833 | 5/1939 | Plotkin . | |
| 2,200,972 | 5/1940 | Stein | 190/41 |
| 2,235,615 | 3/1941 | Huffaker | 273/136 |
| 2,277,176 | 3/1942 | Wagner | 16/163 |
| 2,316,716 | 4/1943 | Ries . | |
| 2,390,945 | 12/1945 | Kleinberg | 220/334 |
| 2,813,295 | 11/1957 | Atkinson | 16/163 |
| 2,950,792 | 8/1960 | Axtell | 190/49 |
| 3,141,535 | 7/1964 | Hamilton | 190/41 |
| 3,458,216 | 7/1969 | Harrison | 281/45 |
| 3,583,556 | 6/1971 | Wagner | 206/16 |
| 3,744,864 | 7/1973 | Schmitz | 16/115 |
| 3,805,327 | 4/1974 | Walker | 16/159 |
| 3,822,906 | 7/1974 | Gaines | 292/251.5 |
| 3,831,986 | 8/1974 | Kobayashi | 292/201 |
| 3,967,708 | 7/1976 | Gregg et al. | 190/41 B |
| 3,995,704 | 12/1976 | Blickman | 273/131 B |
| 4,130,284 | 12/1978 | Fuks | 273/248 |
| 4,418,805 | 12/1983 | Wolff . | |
| 4,428,481 | 1/1984 | Basili . | |

FOLDING CASE

BACKGROUND OF THE INVENTION

1. Field of the Invention.

The present invention relates generally to cases suitable for carrying or storing articles and, more particularly, but not by way of limitation, to cases suitable for use as folding game boards.

2. Brief Description of the Prior Art.

Cases, or containers, used to carry or store articles are commonly constructed to include two hingedly connected members so that a case having such a construction can be opened, to provide free access to the interior of the case, and closed, to form an enclosure for the articles, by relative pivotation of the two sections. Common examples of such cases include the traveler's suitcase and game boards that are constructed in the form of a case so that accessories used to play the game can be stored within the game board when the board is not in use.

A problem that has long existed with prior art cases is that, for aesthetic and other reasons, a case may be called upon to incorporate in its construction criteria which conflict. The use of a case as a folding game board provides an example. Many board games are played on a flat playing surface and it is often desired, for simplicity of construction and aesthetic reasons, that interior floor panels of the two sections of the case provide such playing surface when the case is opened. Where this situation arises, a problem is presented. For the case to carry out its storage or transport function, the floor panels must have raised edges or walls that meet when the case is closed and, together, completely surround the interior of the case. This function can easily be provided by extending the wall on the floor panel of each section completely about the floor panel and hingedly connecting one side of one section to one side of the other section at the upper edges of the walls. However, this form of construction conflicts with the requirement that the playing surface be flat. The walls of the connected sides of the two sections will form a ridge that extends transversely across the center of the playing area when the case is open. Thus, unless the ridge can be incorporated into the game board as an essential element thereof; for example, as in U.S. Design Pat. No. 256,594 issued Aug. 26, 1980 to Tawil, such board being designed for the game of backgammon, the ridge is an objectionable feature to players of the game. For example, chess players would not accept a game board with a ridge extending across the center of the board because the ridge would interfere with the play of the game.

The ridge can be eliminated in various ways but the elimination of the ridge can give rise to other objections to the case. For example, the ridge can be eliminated by angling the walls of the case sections upwardly from meeting sides of the case sections and hingedly connecting the floor panels as disclosed in U.S. Design Pat. No. 204,277 issued Apr. 5, 1966 to Neal. While this solution is workable, it limits the flexibility of the game board designer to select features to be incorporated into the construction of his board. Similarly, the ridge can be eliminated by separating the two sections by a connecting member, or panel, which is hingedly connected to the floor panels of the two case sections and extends therebetween as disclosed in U.S. Pat. No. 4,130,284 issued Dec. 29, 1978 to Fuks. The problem with this solution is that gaps are left in the combined wall of the board, formed by the walls of the sections, when the board is opened and such gaps are aesthetically displeasing to many persons. While the gaps can be filled by separate inserts, as disclosed in the Fuks patent, many would consider the use of the inserts to be a bother and, in addition, the inserts might also become lost. The gaps can also be filled by inserts that are attached to the sections to move into position when the case is opened, an example of such inserts being disclosed in United Kingdom Pat. No. 1,436,493 to Fattorini et al., the specification of which was published on May 19, 1976, but such solution will often have the disadvantage of forming a prominent inhomogeneity in the wall of the board in order to provide clearance for the inserts in the walls when the case is closed.

Similar problems can arise in the construction of other types of cases; for example, in the construction of suitcases. In general, where it is desired to provide a complete wall about floor panels of a case when the case is open, while still permitting the case to be closed and, when closed, to completely surround the interior of the case, the case has, in the past, had to be constructed to either be inconvenient to the user, or to have a ridge extending across the center of the case when the case is open, or to have gaps in the wall of the case when it is opened, or to have prominent and, accordingly, aesthetically objectionable inhomogeneities in the structure of the walls of the two sections of the case.

SUMMARY OF THE INVENTION

The present invention overcomes all of these problems to provide a case in which the interior of the case is completely surrounded in the closed position of the case and has a wall that extends completely about the floor panels of the case sections in the open position of the case without forming a ridge across the center of the case, without noticeably affecting the aesthetic qualities of the case in the open position, and without entailing any inconvenience on the part of the user to achieve these benefits. In particular, the two case sections of the case of the present invention are each comprised of a floor panel and a wall extending only partially about the floor panel to leave a gap in the wall and the two sections are hingedly connected at the gaps in the walls and at the upper edges of the walls. Such construction provides a combined wall that extends about the combined floor panels substantially without interruption when the case is open. In order that the case will completely surround its interior, despite the gaps in the walls and the placement of the hinged connections between the two sections, the case is further provided with a closure panel that is supported by the two sections to automatically pivot between a position in which a laminar central portion of the closure panel overlays adjacent portions of the floor panels when the case is opened and is pivoted to a position in which the central portion of the closure panel extends across the gaps in the walls of the sections when the case is closed. By constructing the case in this manner, the case manufacturer can shape portions of the case sections to eliminate any ridge across the central portion of the case when the case is opened and to provide the combined wall with a substantially homogeneous appearance throughout its length without interfering with the ability of the case to be closed.

An object of the present invention is to eliminate problems that have existed with prior art case designs.

Another object of the invention is to provide a hitherto unavailable flexibility in case design to manufacturers of cases.

Still a further object of the invention is to provide a case which combines a homogeneous wall structure, when the case is opened, with closure of all sides of the case when the case is closed.

Another object of the invention is to separate functional and aesthetic characteristics of cases whereby desired functional characteristics can be achieved concurrently with desired aesthetic characteristics.

Other objects, advantages and features of the present invention will become clear from the following detailed description of the preferred embodiment of the invention when read in conjunction with the drawings and appended claims.

BRIEF DESCRIPTION OF THE DRAWINGS

FIG. 16 is a plan view of the closure panel of the case.

FIG. 19 is an end elevational view of the closure panel.

FIG. 20 is a plan view on an enlarged scale and in partial cross section and partial cutaway of portions of the case wherein the two sections thereof are connected.

FIG. 21 is an elevational view on enlarged scale and in partial cutaway and partial cross section taken along line 21—21 of FIG. 20.

BRIEF DESCRIPTION OF THE PREFERRED EMBODIMENT

Figure 1:
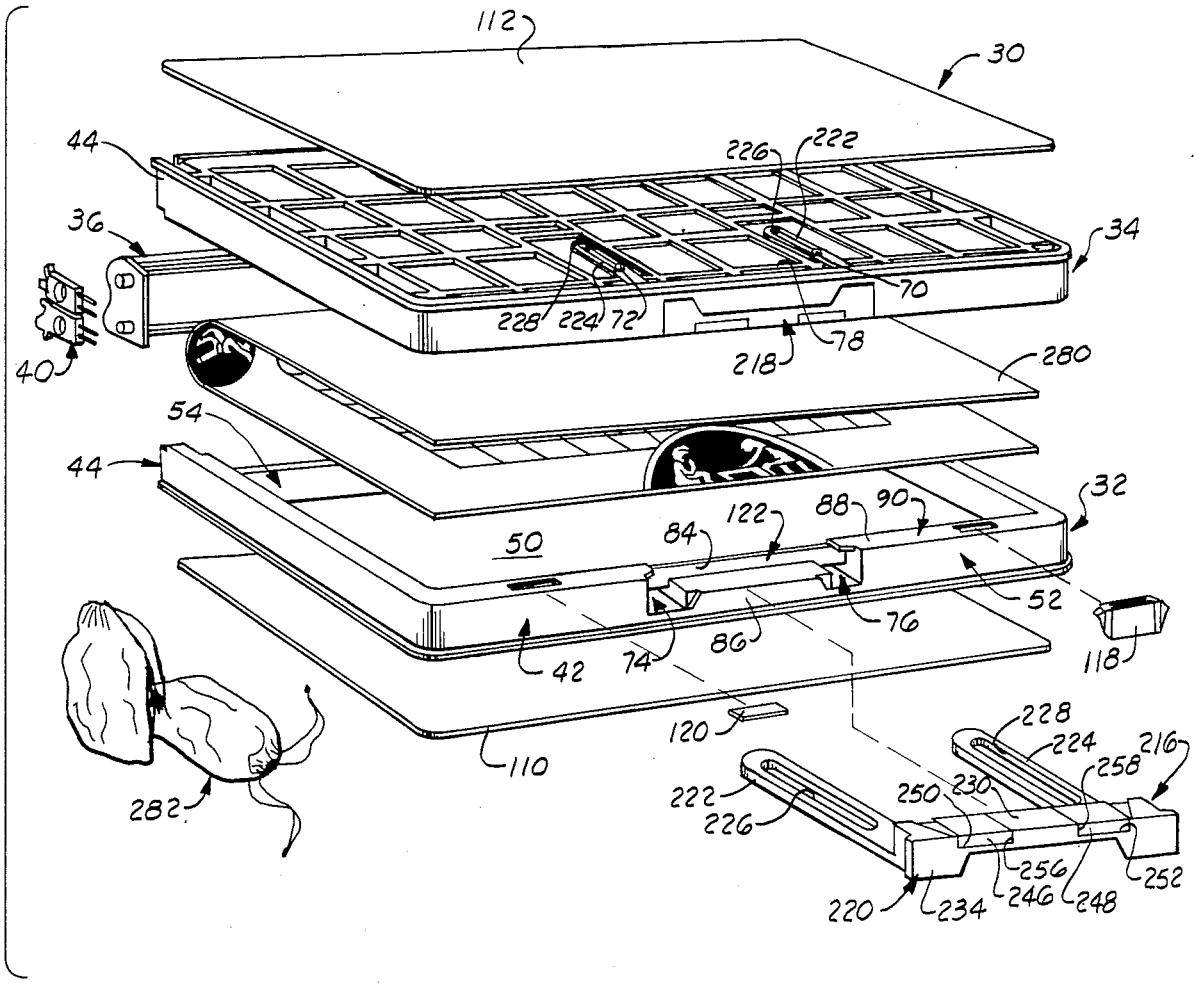
FIG. 1 is a partially exploded perspective view of a case, constructed in accordance with the present invention, from the closed position thereof and illustrating the application of the case to use as a game board.
Figure 2:
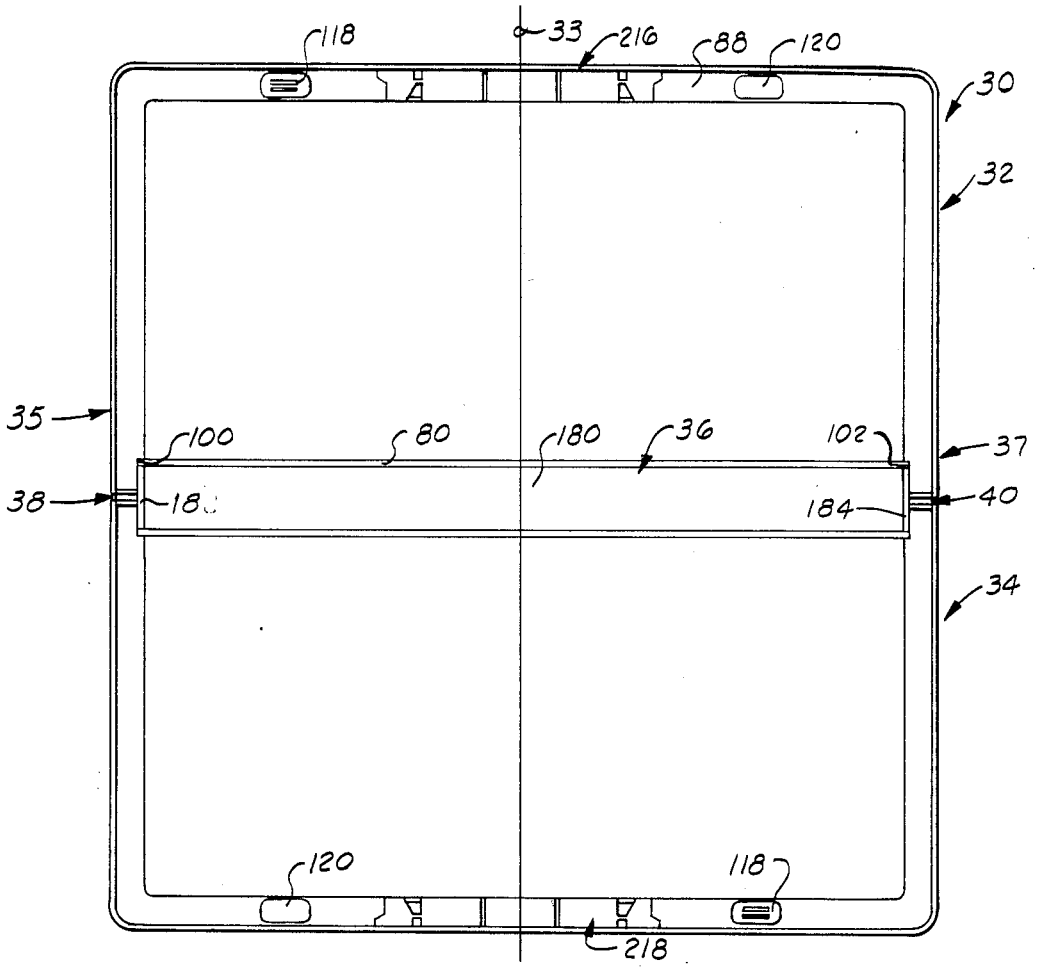
FIG. 2 is a plan view of the case of FIG. 1 in the open position thereof.
Figure 3:
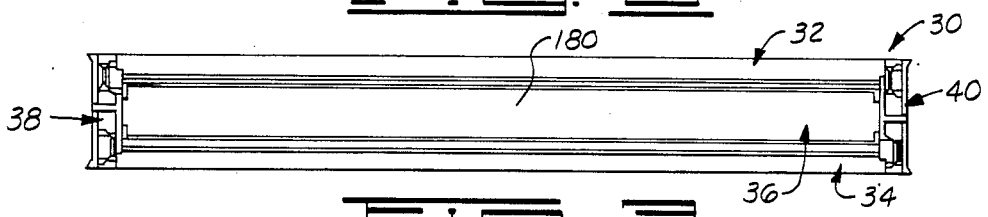
FIG. 3 is a rear elevational view of the case in the closed position thereof.

Referring now to the drawings in general and to FIGS. 1, 2 and 3 in particular, shown therein and designated by the general reference numberal 30 is a case constructed in accordance with the present invention. In the drawings, the case 30 has been illustrated as a game board in which pieces or tokens used in the play of the game can be stored when the board is not in use and additional elements adapting the case 30 to this use have been included in FIG. 1. While the case 30 is particularly suited to such use, it will be recognized that the case 30 is not limited to this particular application. Rather, such application and elements by means of which the case is adapted to the application are to be considered to be only an exemplification, rather than a limitation, of the case 30.

As can be seen in FIGS. 1-3, the case 30 generally comprises a first case section 32; a second case section 34; and a closure panel 36. First and second hinge members, 38 and 40 respectively (the first hinge member 38 is not illustrated in FIG. 1), portions of which form portions of the case sections 32 and 34 when the case is assembled, hingedly connect the two case sections 32, 34 so that the case 30 can be disposed in an open position shown in FIG. 2 and in a closed position shown in FIG. 3 and from which the exploded view shown in FIG. 1 has been drawn. (The hinge members 38 and 40 can conveniently be constructed of polypropylene or polyethylene for flexibility.) In addition, and as will be discussed below, the hinge members 38, 40 support the closure panel 36 such that the closure panel 36 assumes two different positions corresponding to the two positions of the case 30. In particular, in the open position of the case 30, the closure panel 36 assumes an overlaying position, shown in FIG. 2, to portions of the case sections 32 and 34 such that the closure panel is nested within the case sections 32, 34. In the closed position of the case, as indicated in FIG. 1, the closure panel 36 assumes a blocking position in which the closure panel 36 closes one side of the case 30 so that articles can be contained within the case 30 in the closed position thereof.

Figure 4:
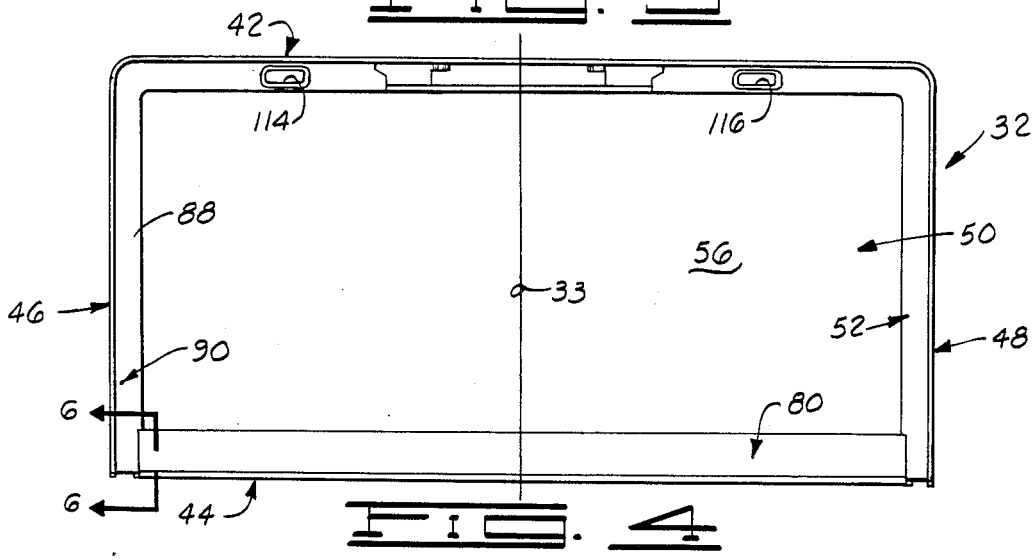
FIG. 4 is a plan view of one section of the case of FIG. 1.
Figure 12:
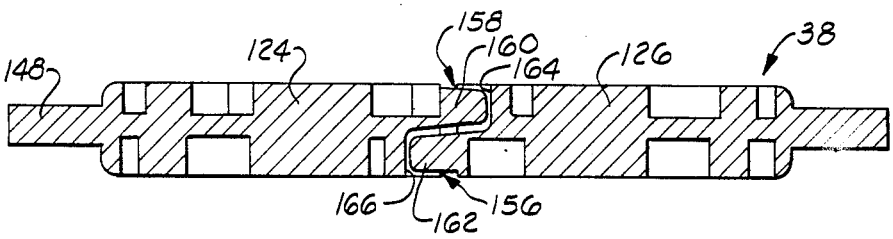
FIG. 12 is a cross section of the hinge member taken along line 12—12 of FIG. 8.
Figure 13:
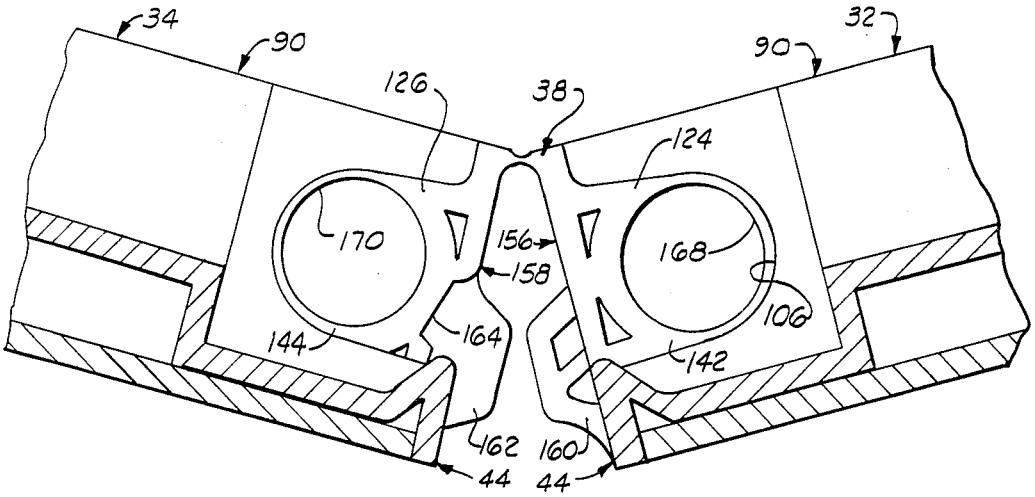
FIG. 13 is an enlarged elevational view in partial cross section of portions of the two sections of the case and a hinge member as viewed from the inside of the case and for a position of the case approaching the opened position thereof. The closure panel has been deleted from FIG. 13 to illustrate construction details of the sections of the case.
Figure 14:
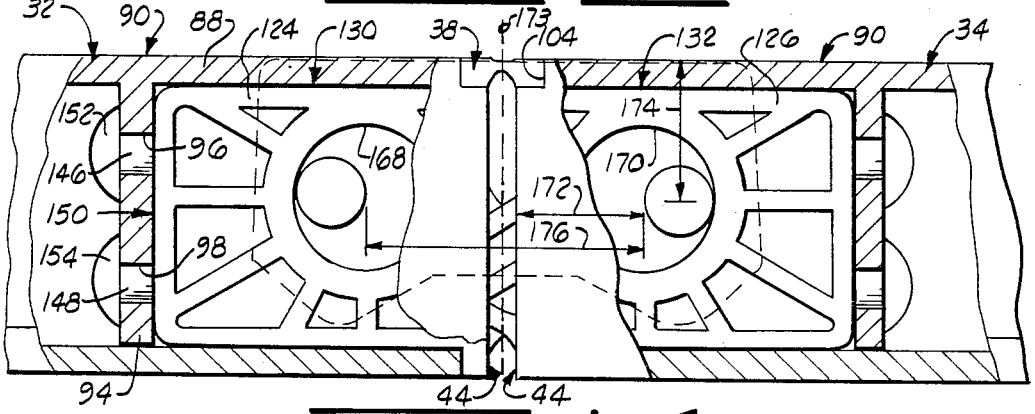
FIG. 14 is an elevational view in partial cross section and partial cutaway of the portion of the case shown in FIG. 13 as viewed from the outside of the case and for the open position of the case.
Figure 15:
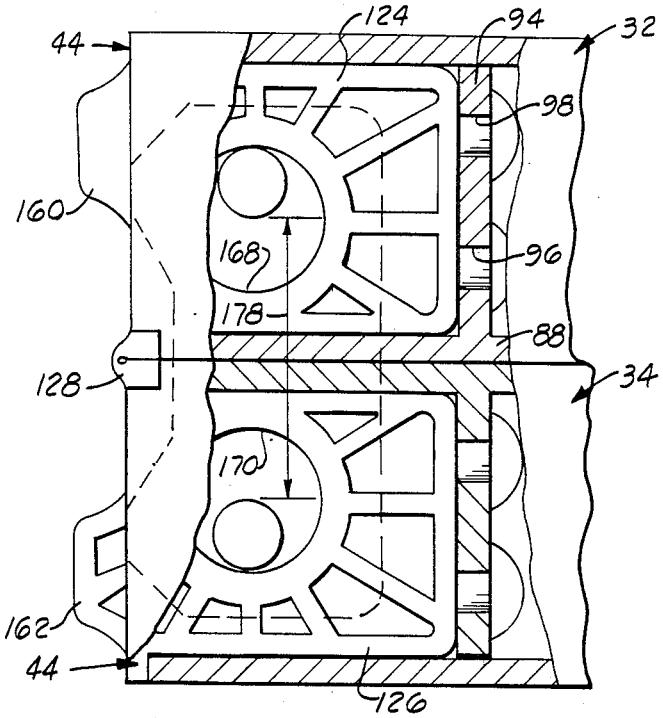
FIG. 15 is an elevational view in partial cross section and partial cutaway of the portion of the case shown in FIG. 13 as viewed from the outside of the case and for the closed position of the case.
Figure 15:
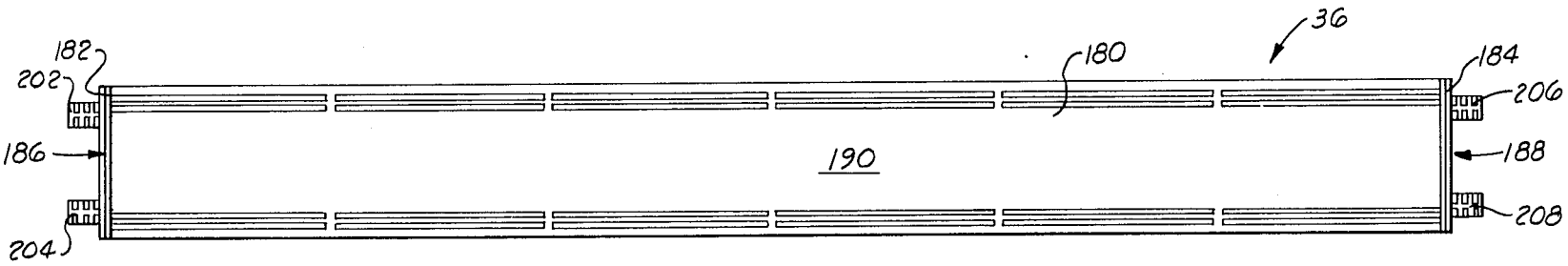

In discussing the construction of the case 30, it will be useful to first consider the construction of the case sections 32, 34 and the manner in which the case sections are hingedly connected by the hinge members 38, 40 as a basis for a further discussion describing the mounting of the closure panel 36 on the case sections 32, 34. Accordingly, FIGS. 4–7 have been included to illustrate the construction of the first case section 32; FIGS. 8–12 have been provided to illustrate the construction of the first hinge member 38; and FIGS. 13–15 have been provided to illustrate the connection between the case sections 32, 34 via the first hinge member 38. (The second case section 34 is identical to the first case section 32; the second hinge member 40 is identical to the first hinge member 38; and the manner in which the second hinge member connects the case sections is identical to the manner in which the first hinge member connects the case sections so that the second case section 34, the second hinge member 40, and constructional details relating to the connection of the case sections by the second hinge member 40 need not be separately illustrated and described for purposes of the present disclosure. With respect to the connection of the case sections 32, 34 by the second hinge member 40, the case sections 32, 34 are bilaterally symmetric with respect to the axis 33 in FIGS. 2 and 4 so that portions of the case sections 32, 34 adjacent the first hinge member 38 of one lateral side 35 of the case mirror image portions of the case sections 32, 34 adjacent the second hinge member of the opposite lateral side 37 of the case. Accordingly, only portions of the case sections adjacent the first hinge member 38 have been illustrated in the drawings; portions adjacent the second hinge member 40 will be understood to have the same features and construction details to be described below. Thus, FIGS. 6 and 7 illustrate construction details of the first case section 32 adjacent the first hinge member 38 in the assembled case; portions of the first case section 32 adjacent the second hinge member 40 have the same features in mirror image and corresponding portions of the second case section 34, adjacent both hinge members are provided with the same construction details. Similarly, FIGS. 13–15 and FIGS. 20–23 illustrate portions of the case sections 32, 34 adjacent the first hinge member 38, FIGS. 13 and 21–23 as viewed from inside the case; FIGS. 14 and 15 as viewed from outside the case; and FIG. 20 as viewed from above the case in the open position thereof. Portions of the case sections 32, 34 adjacent the second hinge member are constructed in the same manner as has been shown for the portions illustrated in these figures.)

Figure 5:
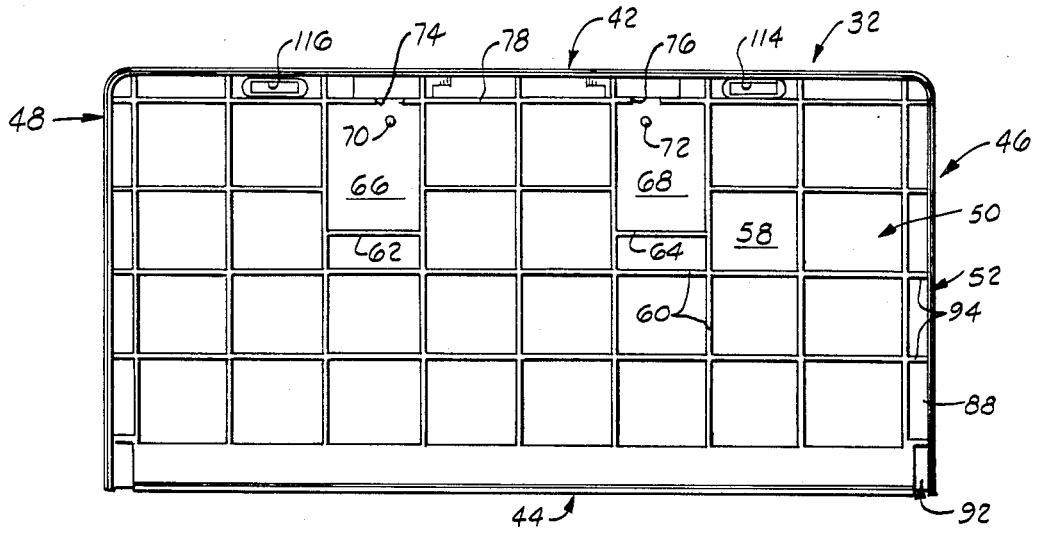
FIG. 5 is a bottom view of one section of the case.
Figure 6:
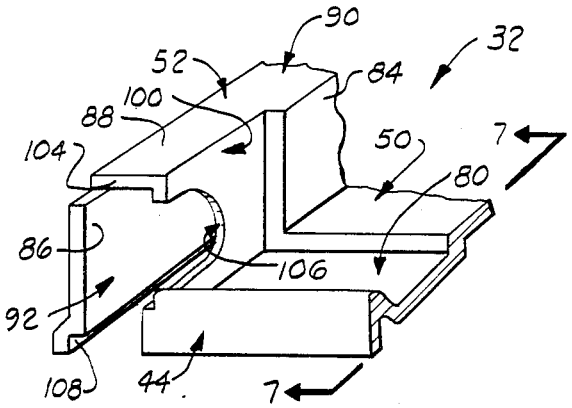
FIG. 6 is an enlarged perspective view in partial cross section and partial cutaway of a portion of one section of the case taken along line 6—6 of FIG. 4.
Figure 7:
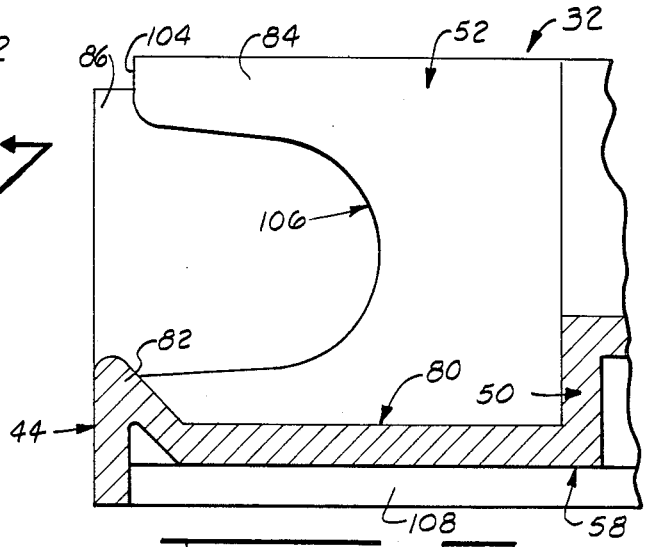
FIG. 7 is a further enlarged cross section in side elevation and partial cutaway of the portion of the case shown in FIG. 6 taken along line 7—7 of FIG. 6.
Figure 8:
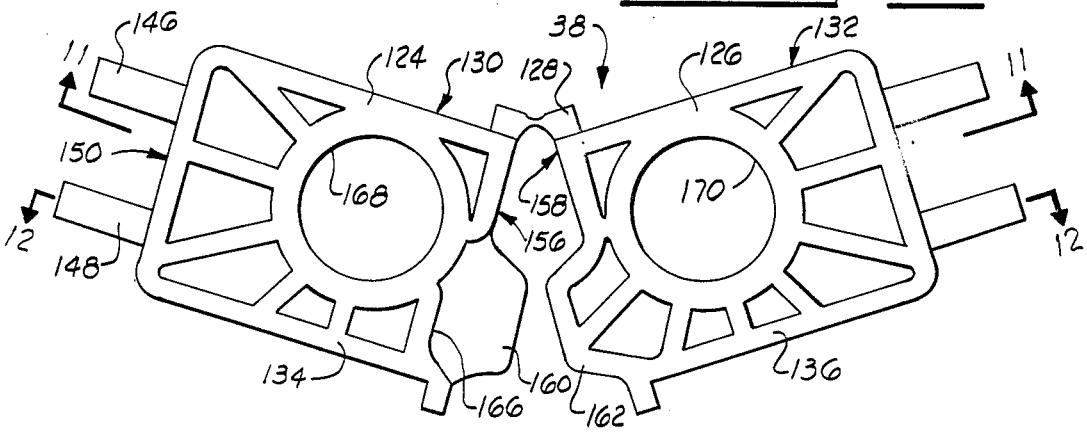
FIG. 8 is an elevational view of one side of a hinge member forming a portion of the case in the configuration of the hinge member in which the case would be partially open.
Figure 9:
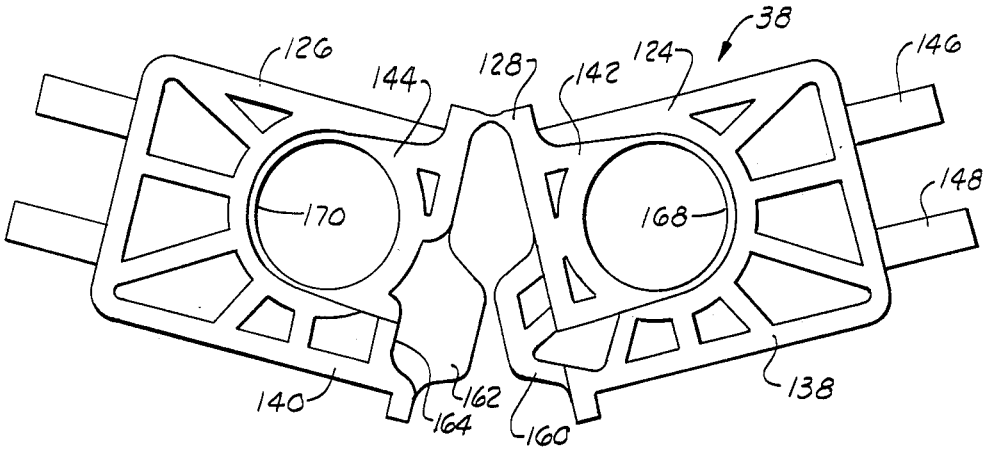
FIG. 9 is an elevational view similar to FIG. 8 illustrating the other side of the hinge member.
Figure 10:
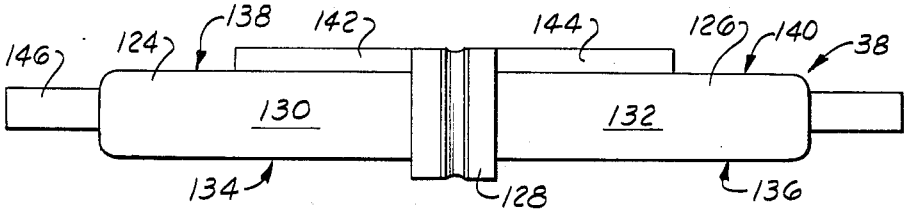
FIG. 10 is a plan view of the hinge member in the configuration in which the hinge member would exist in the open position of the case.
Figure 11:
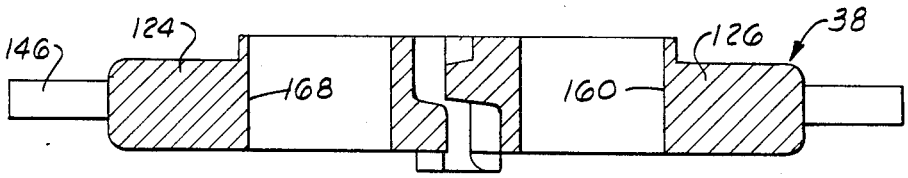
FIG. 11 is a cross section of the hinge member taken along line 11—11 of FIG. 8.

Referring first to FIGS. 4–7, the first case section 38, which in the application as shown is preferably molded in one piece from a high impact plastic, has a forward side 42; a rear side 44; a first lateral side 46 and a second lateral side 48. The rear side 44 of the first case section 32 is defined by one edge of a floor panel 50 of which the first case section 32 is comprised and the remaining sides of the first case section 32 are defined by a wall 52 that is attached to the floor panel 50 on three sides thereof and extends about the floor panel 50 to leave a gap in the wall 52 at the rear side 44 of the case section 32. (The gap in the walls of the case sections can be most easily seen for the second case section 32 in FIG. 1, the gap in such case section having been designated by the numeral 54 in FIG. 1.) The floor panel has a substantially planar upperside 56 (FIG. 4) and a substantially planar underside 58 (FIG. 5) and the floor panel 50 is stiffened by a plurality of reinforcing ribs 60 integrally molded on the underside 58 of the floor panel 50 to divide the underside 58 of the floor panel 50 into a plurality of generally rectangular portions. Two of the ribs 60, designated 62 and 64 in FIG. 5, are offset from the generally square pattern of the ribs 60 so that two of the portions into which the underside 58 of the floor panel 50 is divided, such portions being designated by the numerals 66 and 68 and such portions being among the portions nearest the forward side 42 of the case section 32, are elongated toward the rear side 44 of the first section 32. Circular projections 70 and 72 are formed on the underside 58 of the floor panel 50, within the areas 66 and 68, and apertures 74 and 76 are formed through the reinforcing rib, designated 78 in FIG. 5, between the areas 66 and 68 and the forward side 42 of the case section 32 for a purpose to be discussed below. Adjacent the rear side 44 of the case section 32, a recess 80 (see FIGS. 4, 6 and 7) is formed in the upper side 56 of the floor panels 50, preferably by offsetting portions of the floor panel 50 adjacent the rear side of the case section 32, toward the underside 58 thereof and by an amount substantially equal to the height of the ribs 60, as can be seen by inspection of FIGS. 1, 5, 6 and 7. The depth of the recess 80 is dictated by the thickness of the floating panel 50 and the height of the ribs 60 are commanded by the level of offset on the backside of the recess 80. The purpose of the recess 80 and the manner in which it is preferably formed will be discussed below. In addition, a fold 82 is preferably formed in the floor panel 50 to extend along the rear side 44 of the case section 32 as has been particularly shown in FIGS. 6 and 7.

In one preferred construction of the case 30, the wall 52 has the form of a folded panel as can be particularly seen in FIG. 6. As shown therein, the wall 52 comprises an inner bulkhead 84 which is attached to the floor panel 50 along three edges thereof and extends upwardly therefrom to enclose the upperside 56 of the floor panel 50 at all sides of the case 32 excepting the rear side 44 thereof. The wall 52 further includes an outer bulkhead 86, that extends about the inner bulkhead 84 in a substantially parallel relation thereto throughout the length of the wall 52, and a connecting bulkhead 88 that is connected between the inner and outer bulkheads, 84 and 86 respectively, at an upper edge 90 of the wall 52 so that a downwardly facing channel 92 is formed in the wall 52 between the inner and outer bulkheads 84 and 86, thereof. As can be seen in FIGS. 5, 14 and 15, a plurality of reinforcing webs 94 are molded into the channel 92, the webs 94 extending from the connecting web 88 to a position even with the tops of the reinforcing ribs 60 to, in effect, extend the ribs 60 to the outer bulkhead 82. As can be seen in FIGS. 14 and 15 and, with reference to the second case section 34 which is identical to the first case section 32, in FIG. 20, the reinforcing webs 94 are formed integrally with the bulkheads 84–88. As can also been seen in FIGS. 14 and 15, a pair of apertures 96, 98 are formed through the webs 94 nearest the rear side 44 of the case section 32 for a purpose that will be discussed below.

Returning to FIG. 6 and referring additionally to FIG. 2, recesses 100, 102 are formed in the inner surface of the wall 52 at each end of the gap 54 therein, preferably by offsetting portions of the inner bulkhead 84 adjacent the rear side 44 of the case section 32 toward the outer bulkhead 86 as has been particularly shown in FIG. 6. The purpose of the recesses 100 and 102, which extend the recess 80 in the floor panel 50 upwardly along the interior surface of the wall 52, as shown in FIG. 6 for the recess 100, will be discussed below.

As can also been seen in FIG. 6, and additionally in FIG. 7, a notch 104 is formed in the upper edge 90 of the wall 52 adjacent the rear side 44 of the case section 32 and at one end of the gap formed in the wall 52. A similar notch (not shown) is formed in the upper edge of the wall 52 at the other end of the gap in the wall 52 and, at both ends of the gap, arctuate cutouts, such as the cutout 106 shown in FIGS. 6 and 7, are formed in the inner bulkhead 84 to extend inwardly from the rear side 44 of the case section 32. The purpose of the notches 104 and the cutouts 106 will become apparent below.

As is particularly shown in FIGS. 6 and 7, the outer bulkhead 86 extends downwardly of the underside 58 of the floor panel 50 and has an inwardly facing shoulder formed therein so that lower portions of the outer bulkhead 86 coact with portions of the fold 82 in the floor panel 50 to form a rim 108 about the underside 58 of the floor panel 50. The rim 108 so formed in the case section 32 and a corresponding rim formed in the case section 34 facilitate the mounting of face panels 110, 112 (FIG. 1) on the sections 32 and 34 respectively, the face panels 110 and 112 serving to protect portions of the case 30 to be described below and further serving to provide the case 30 with an exterior surface having a pleasing appearance. In particular, the face panels 110, 112 are sized to fit within the rims 108 and can be secured to the case sections 32, 34 by means of a suitable adhesive.

In one preferred embodiment of the case 30, such as the embodiment in which the case 30 is adapted to use as a game board, apertures 114 and 116 are formed through portions of the connecting bulkhead 88 that extend along the forward side of the case section 42 (see FIGS. 4 and 5) and portions of the connecting bulkhead 88 about the apertures 114, 116 are depressed to provide for the mounting, in the aperture 114, of a magnet 118 (FIG. 2) whose upper surface is flush with the upper edge 90 of the wall 52 and to provide for the mounting, in the depression about aperture 116, of a striker plate 120 (FIG. 2) whose upper surface is similarly flush with the upper edge 90 of the wall 52. (The magnet 118 can conveniently be constructed of one or more pieces of magnetized material imbedded in a plastic shell that can be snapped into an aperture to facilitate securing the magnet to the case section 32. Such magnets are conventional and need not be further described herein. The striker plate is conveniently mounted above the aperture 116 via a suitable adhesive.) The striker plate 120 is constructed of a magnetic material so that, in combination with the identity of construction of the case sections 32, 34, the magnets 118 and striker plates 120 in the two case sections will hold the case 30 in the closed position thereof. In particular, because of the identity of construction of the two case sections 32, 34, the magnet 118 in one case section will align with the striker plate 120 in the other case section when the case 30 is closed as can be seen by comparing FIGS. 1 and 2.

As can also be particlarly seen in FIG. 1, a niche 122 is formed in the wall 52 at the forward side 42 of the case section 32 to receive a portion of a handle for the case 30 that will be discussed below. The niche 122 can conveniently be formed by displacing portions of the connecting bulkhead 88 from the upper edge 90 of the wall 52 toward the floor panel 50 and eliminating portions of the outer bulkhead 86 between the so-displaced portions of the connecting bulkhead 88 and the upper edge 90 of the wall 52. It will be noted, from a comparison of the two case sections 32, 34 in FIG. 1, that the reinforcing rib nearest the forward side of a case section (numeral 78 for the case section 34 in FIG. 1) is aligned with the inner bulkhead 84 of the wall 52 along the major portion of the forward side 42 of a case section. Thus, by making portions of the niche 122 of a sufficient depth, the apertures 74, 76 (FIG. 5) in the ribs 78 of the case sections can be used to communicate the under sides of the floor panels of the case sections with portions of the niches in the walls of the case sections as indicated for the niche 122 in the case section 32 in FIG. 1. The purpose of such communication will become clear below.

Referring now to FIGS. 8–12, shown therein is the construction of the first hinge member 38 which is constructed of a relatively flexible, relatively low melting point plastic. The hinge members 38, 40 are each comprised of first and second hinge elements 124, 126 which are dimensioned to fit within portions of the channels 92 in the walls of the case sections adjacent the rear sides 44 of the case sections as has been illustrated in FIGS. 13–15 and FIG. 20 to which reference will be made during the description of the hinge member 38. In particular, the first hinge elements 124 of each of the hinge members 38, 40 fit within the channel 92 in the wall of the first case section 32, to either side of the gap in the wall and at the rear side 44 of the case section, and are incorporated thereinto to provide such wall with a feature that will be discussed below. Similarly, the second hinge elements 126 of each of the hinge members 38, 40 are similarly incorporated into the wall of the second case section 34.

The hinge elements 124, 126 of each of the hinge members 38, 40 are connected by a thin, integrally molded bridge 128 at upper edges 130, 132 of the hinge elements 124, 126 respectively so that, when the hinge elements 124, 126 are incorporated into the walls of the case sections 32, 34, the bridges 128 of the hinge members 38, 40 form a hinge connection between the two case sections 32, 34 at the upper edges 90 of the walls thereof and, as can be seen by comparing FIGS. 1 and 2, at the ends of the gaps in the walls that are formed at the rear sides of the case sections 32, 34.

For this purpose, the upper edges 130, 132 of the hinge elements 124, 126 are positioned along the connecting bulkheads 88 of the walls 52 as is particularly shown for the upper edge 130 of the hinge element 124 and the connecting bulkhead 88 of the wall of the case section 32 in FIG. 14.

The hinge elements 124, 126 have exterior sides 134, 136 respectively which, as shown for the hinge element 126 in FIG. 20, abut the outer bulkheads of the case section walls when the hinge elements are inserted in the channels in the walls of the case sections 32, 34 and interior sides 138, 140 which similarly abut the inner bulkheads of the case sections walls. On their interior sides 130, 140, the hinge elements 124, 126 are provided with plate-like projecting portions, 142, 144 respectively, that are shaped to mate with the cutouts 106 in the interior bulkheads of the case section walls so that the projecting portions 142, 144 fit within the cutouts, as shown in FIG. 13, when the hinge elements are inserted into the channels formed in the case section walls to precisely position the hinge elements 124, 126 with respect to remaining portions of the case 30. These projections extend to the bridge 128 and portions of the bridge 128 extend outwardly of the exterior sides of the hinge elements 124, 126 so that the bridges 128 of the two hinge members 38, 40 fill the notches 104 in the upper edges of the walls, as can be seen in FIGS. 14 and 20, to continue the generally uniform structure of the walls of the case sections 32, 34 about the floor panels 50 of the case sections 32, 34. (This uniform structure of the walls is further carried out despite the niches 122 formed in the walls in a manner to be discussed below.)

To secure the first hinge element 124 to the first case section 32, two circular projections 146, 148 are formed on a forward side 150 of the first hinge element 124 to enter the apertures 96 and 98 in the reinforcing web 94 when the first hinge element 124 is inserted into the channel in the wall of the first case section 32 as has been shown in FIG. 14. The low melting point characteristic of the plastic of which the hinge members are constructed permit distal portions of the projections 146, 148 to be melted to form beads 152, 154 that securely lock the first hinge element 124 to the web 94 as shown in FIG. 14. The second hinge element 126 is similarly provided with projections (not numerically designated in the drawings) for similarly securing the second hinge element to the case section 34.

The hinge elements 124, 126 have rear sides, 156 and 158 respectively, which are disposed along the rear sides 44 of the case sections 32, 34 when the hinge elements are mounted on the case section 32, 34 as has been discussed above. As can be seen in FIGS. 13 and 14, the rear sides 156 and 158 will be in a facing relation when the case 30 is in the open position but, as can be seen in FIG. 15, the sides 156, 158 will extend substantially coplanarly when the case 30 is in the closed position thereof. As can also been seen in FIG. 15, the bridge 128 will be folded on itself in the closed position of the case 30 to project slightly outwardly of the rear sides 44 of the case sections 32, 34 so that the bridges 128 are subject to damage should the case 30 be placed on a support, while in the closed position thereof, such that the case 30 rests on the rear sides 44 of the two sections. The hinge members 124, 126 are constructed to prevent such damage from occurring. In particular, projections 160, 162 are formed on the rear sides 156, 158 of the hinge members 124, 126 respectively to extend outwardly of the rear sides 44 of the case sections 32, 34 a distance sufficient to prevent engagement of the hinge 128 with a supporting surface should the case 30 be rested on the rear sides of the case sections when the case 30 is closed. In order to prevent the projections 160, 162 from interfering with the positioning of the case 30 in the open position shown in FIG. 14, mating recesses 164, 166 are formed in the rear sides 158, 156 respectively of the second and first hinge elements 126, 128 respectively. That is, the recess 164 in the rear side 158 of the second hinge element 126 is positioned to receive the projection 160 on the rear side 156 of the first hinge element 124 and the recess 166 in the rear side 156 of the first hinge element 124 is positioned to receive the projection 162 on the rear side 158 of the second hinge element 126 as can be seen in FIGS. 12 and 14.

For mounting the closure panel 36 on the case section 32, 34, in a manner to be discussed below, holes 168, 170 are formed through the first and second hinge elements, 124 and 126 respectively to intersect the interior sides 138, 140 and exterior sides 134, 136 of the hinge elements 124, 126. As can be seen in FIGS. 13 and 21, and FIG. 20 for the hole 168, the holes 168, 170 form sockets in the walls of the case sections 32, 34 adjacent the gaps formed through such walls at the rear sides of the case sections. (Only the sockets formed by the holes 168, 170 through the first hinge element 38 have been illustrated in the drawings. Similar sockets are formed by holes formed through the hinge element 40, at the opposite ends of the gaps in the walls of the case sections 32, 34, the case sections being bilaterally symmetric about the axis 33 extending perpendicularly to the rear sides 44 of the case sections 32, 34 as has been noted above. The holes 168, 170 will sometimes be referred to herein as the sockets 168, 170.)

It will be useful, before proceeding to the description of the closure panel 36 and its mounting on the case sections 32, 34, to briefly summarize the features of the case sections 32, 34 and their connection via the hinge members 38, 40 by means of which the mounting of the closure panel 36 is effected. Each of the case sections 32, 34 comprises a floor panel 50 and a wall 52 extending about three sides of the floor panel 50 to leave a gap in the wall 52 at the rear sides 44 of the case sections. The walls 52 of the case section are channeled by the construction of the walls in the form of a folded panel comprised of the inner, outer and connecting bulkheads and the hinge members 38, 40 are incorporated into the walls of the case sections by (1) inserting the first hinge element 124 of the hinge member 38 into the channel in the wall 52 of the first case section 32 at the rear side 44 of the case section 32 and at one side of the gap in the wall 52 of the first case section 32; (2) by inserting the first hinge element 124 of the second hinge member 40 into the channel in the wall of the first case section 32 at the rear side of the case section 32 and at the opposite side of the gap in the wall of the case section 32; (3) by inserting the second hinge element 126 of the hinge member 38 into the channel in the wall of the second case section 34 at the rear side of the case section 34 and at one side of the gap in the wall of the case section 34; and (4) by inserting the second hinge element 126 of the hinge member 40 into the channel in the wall of the second case 34 at the rear side of the case section 34 and at the other side of the gap in the wall of the case section 34. By this means, the two case sections are hingedly connected at their rear sides and at the upper edges of the walls so that the case sections can be disposed in the open position, in which the gaps in the walls of the case sections, align to provide free communication between the floor panels of the two case sections. However, such construction will leave one side of the case 30, defined by the rear sides of the two sections, open when the case is closed as can be seen by inspection of FIG. 1. As will be discussed below, the closure panel 36 is constructed to close such open side of the case 30 without interfering with the free communication between the floor panels of the two sections when the case 30 is disposed in the open position.

The cutouts 106 formed in the inner bulkheads 84 of the wall of each case section and at each end of the gap in the case section wall, coupled with the projecting portions 142, 144 of the hinge elements 124, 126 respectively, precisely position the sockets 168, 170 in the walls of the case sections at the ends of the gaps in such walls. Thus, at each end of the gap in the wall of each case section, the wall has a socket which is precisely positioned with respect to the rear side of the case section and is similarly precisely positioned with respect to the upper edge 90 of the wall wherein the socket is formed. This positioning of the sockets 168, 170 has been illustrated in FIGS. 14 and 15. The centers of the holes are each displaced from the rear sides 44 of the case sections by a distance 172 which is slightly less than the displacement of the centers of the holes from the upper edge 90 of the walls of the case sections, the latter displacement being shown as the distance 174 in FIG. 14. (The distance between the center of the socket 170 and the dashed line 173 in FIG. 14 is the same as the distance 174 in such Figure.) By this means, an equality in the separation of the sockets at each end of the gaps in the walls of the two case sections is achieved for the two positions of the case 30. That is, when the case 30 is in the open position, as shown in FIG. 14, the centers of the holes 168, 170 in the hinge member 38 (as well as in the hinge member 40) are separated by distance 176 along a line parallel to the floor panels (not shown in FIG. 14) of the two case sections, the floor panels in such position of the case being adjoined along the rear side of the case sections in a substantially coplanar relation by the connection of the two hinge members 38, 40 at the rear sides of the case sections and at the upper edge of the case section walls. (See FIGS. 2 and 21.) In the closed position of the case, the floor panels of the two case sections are disposed in a spaced apart, facing relation and the holes 168, 170 are disposed along a line which extends generally normally to the floor panels. (See FIGS. 1 and 22.) In such position, the centers of the sockets 168, 170 are spaced by a distance 178 and the distances 172 and 174 are selected such that the distances 176 and 178 are substantially equal. Thus, as will be appreciated by those skilled in the art, an object supported by the holes in the hinge members 38, 40 while the case 30 is in one of the open or closed positions will similarly be supportable by the holes in the hinge members in the other of these two positions of the case 30. However, a difference will exist in the support of the object in the two positions of the case 30; a line or plane on the supported object that parallels the line between centers of the two holes in one of the hinge members will parallel the floor panels in the open position of the case but will extend substantially normally to the floor panels in the closed position of the case. Such difference is used to achieve the closure of the case 30 by the closure panel 36 when the case 30 is in the closed position while preventing interference by the closure panel 36 of the free communication between the floor panels of the two case sections when the case 30 is in the open position, the closure panel being supported by the holes 168, 170 in the hinge members 38, 40 for this purpose.

Figure 17:
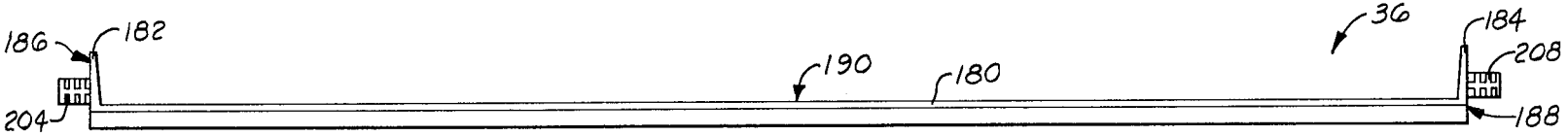
FIG. 17 is a side elevational view of the closure panel.
Figure 18:
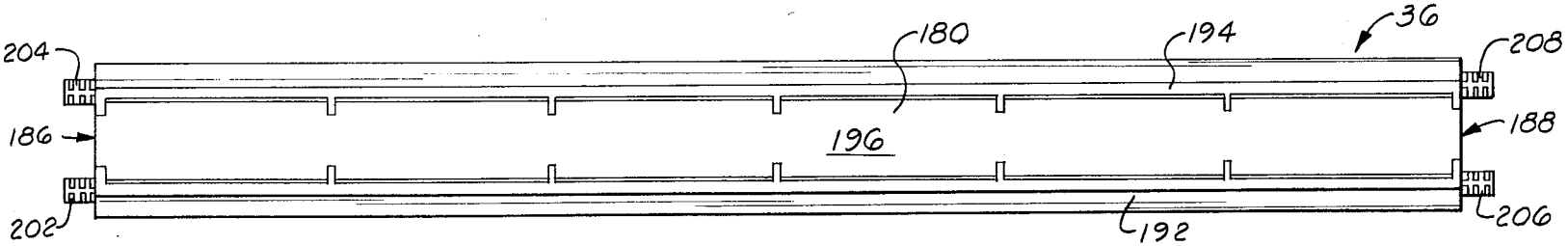
FIG. 18 is a bottom view of the closure panel.
Figure 1:
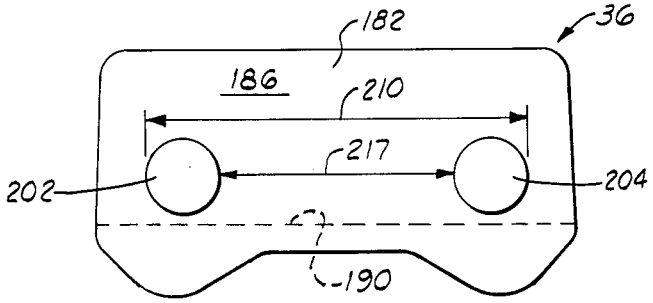
Figure 2:
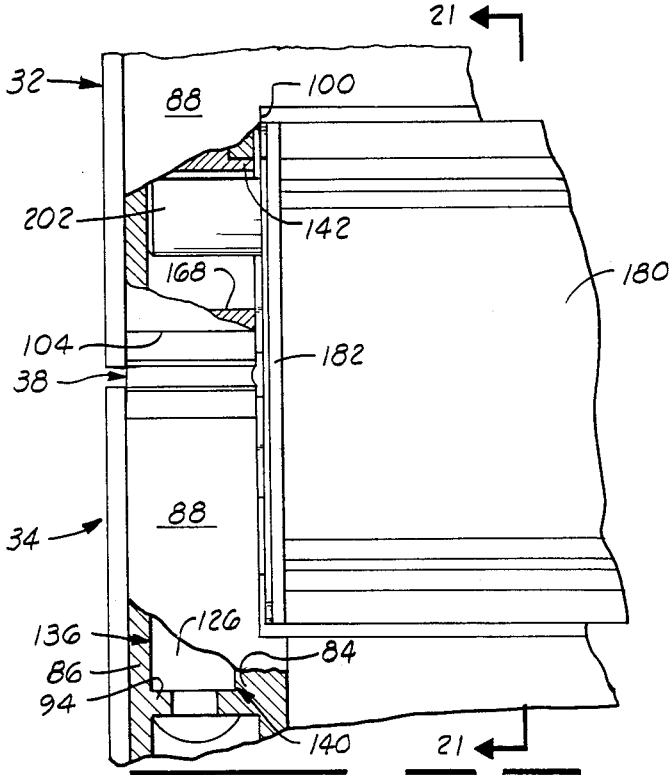
Figure 11:
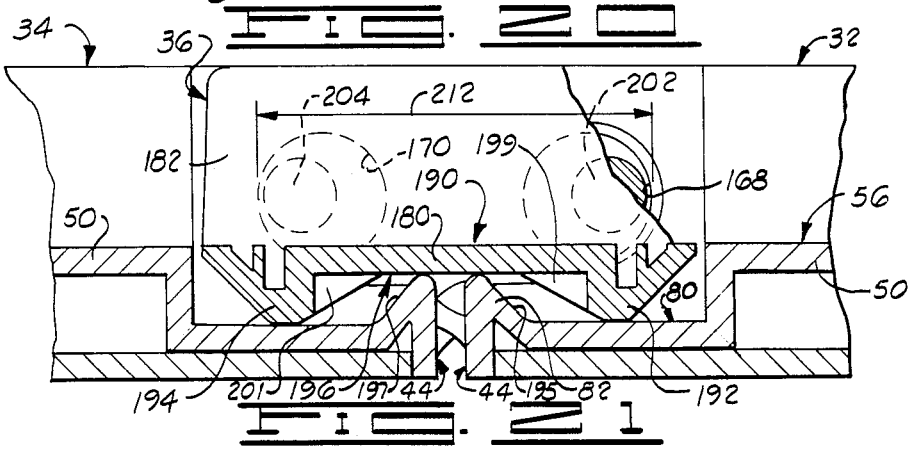
Figure 22:
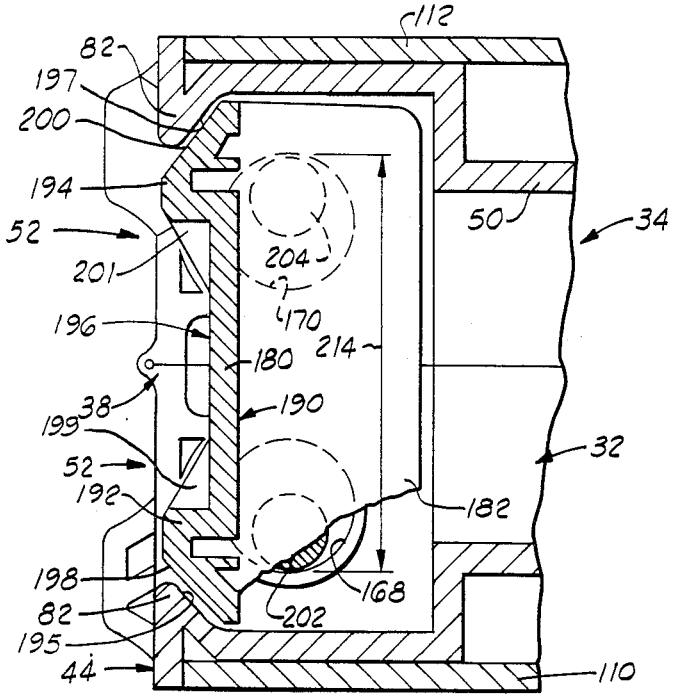
FIG. 22 is an enlarged partial cross section and partial cutaway in side elevation of portions of the case shown in FIG. 21 for the closed position of the case.

Turning now to the closure panel 36, the structure of the closure panel 36 is particularly shown in FIGS. 16–19 and the manner in which the closure panel 36 is mounted on the remaining portions of the case is shown in FIGS. 20–23. As can be seen in FIGS. 16–18, the closure panel is comprised of a laminar central portion 180 having upwardly folded end plate portions 182, 184 at opposite ends 186, 188 thereof. The length of the closure panel, between the ends 186, 188 is selected to be substantially equal to the lengths of the gaps in the walls of the case sections 32, 34 so that the central portion 180 of the closure panel 36 can be mounted on the case sections 32, 34 to overlay adjacent portions of the floor panels of the case sections 32, 34 when the case 30 is in the open position, as shown in FIGS. 2 and 21, and so that the central portion 180 can be extended across the rear sides of the case sections, to close the case 30 when the case 30 is in the closed position, as shown in FIGS. 3 and 22. As is further shown in FIGS. 2 and 20, the recesses 100, 102 in the walls of the case sections are matched to the thicknesses of the end plate portions 182, 184 of the closure panel 36 so that the end plate portions 182, 184 of the closure panel 36 will be disposed within the recesses 100, 102 when the closure panel is mounted on the case sections 32, 34 to carry forward the homogeneous character of the walls of the case sections 32, 34 when the case 30 is in the open position. Similarly, the recesses 80 in the floor panels 50 of the case sections 32, 34 are matched to the overall thickness of the central portion 180 of the closure panel 36 such that the upper surface 190 of the central portion 180 of the closure panel 36 will be flush with unrecessed portions of the uppersides 56 of the floor panels 50 of the case sections 32, 34 when the case 30 is in the open position thereof as is shown in FIG. 21.

As shown in FIGS. 18 and 21, runners 192, 194 are formed on the underside 196 of the central portion 180 of the closure panel 36, the runners 192, 194 extending longitudinally between the ends 186, 188 of the closure panel 36 along opposite lateral sides thereof. As shown in FIG. 22, the runners 192, 194 coact with the folds 82 formed on the floor panels 50 of the case sections 32, 34 to similarly help position the closure panel in the closed position of the case 30, the folds being received between the runners 192, 194 when the case 30 is opened so that the folds 82 will not interfere with the positioning of the closure panel 36 in the open position of the case 30 (FIG. 21). As also shown in FIG. 22, the sides 198, 200 of the runners 192, 194 extending along the lateral sides of the central portions 180 of the closure panel 36 are angled to mate with similarly angled surfaces 195, 197 on the folds 82 when the case is closed and webs 199, 201 extending on an angle from the runners 192, 194 to the underside 196 of central position 180 of the closure panel 36 at the ends of the closure panel 36 similarly present angled edges toward the surfaces 195 and 197 on the folds 82 of the case sections 32 and 34 when the case is open. The purpose of the webs, 199 and 201 and the angling of the sides 198, 200 of the runners 192, 194 and the surfaces 195, 197 on the folds 82 will be discussed below.

Returning once again to FIG. 16–19, the closure panel 36 further comprises circular, projecting lugs 202, 204 integrally molded on the end 186 thereof and similar lugs 206, 208 integrally molded on the end 188 thereof, the line between the centers of each pair of lugs being disposed generally parallel to the upper surface 190 of the central portion of the closure panel 36 as has been shown in FIG. 19. The lugs 202–208, together with the sockets formed in the walls of the case sections 32, 34 via the holes 168, 170 in the hinge members 138, 140, form an assembly for supporting the closure panel 36 in the case sections 32, 34 and for positioning the closure panel 36 in the above described positions in the two positions of the case 30. This assembly (not numerically designated as such in the drawings), will now be described with reference to FIGS. 19–23 which illustrate the lugs 202 and 204 on the end plate 182, the hinge member 38, and the support of the lugs 202, 204 by the hinge member 38 in three positions of the case 30. The lugs 206 and 208 on the end plate 184 are identically supported by the hinge member 40 so that such support need not be discussed for the purposes of the present disclosure.

Referring first to FIGS. 19 and 21, it will be seen that the diameters of the lugs 202, 204 are smaller than the diameters of the sockets 168, 170 into which the lugs 202 and 204, respectively, are positioned in a manner to be discussed below. In addition, the spacing between the centers of the lugs is made larger than the spacing between the centers of the sockets 168, 170 in the open and closed positions of the case 30; that is, the distances 176 and 178 shown in FIGS. 14 and 15, such that the distance between outside edges of the lugs 202, 204, such distance being designated by the numeral 210 in FIG. 19, is substantially equal to the distances between the outside edges of the sockets 168, 170, such distances being designated by the numerals 212 (for the open position of the case 30) and 214 (for the closed position of the case 30) in FIGS. 21 and 22 respectively. (Because of the above described positioning of the sockets 168, 170 in the case sections 32, 34, the distances 212 and 214 will be substantially the same. Thus, the lugs 202, 204 will coact with the holes 168, 170 in the first hinge member 38 (and the lugs 206, 208 will coact with the holes 168, 170 in the second hinge member 40) to position the closure panel 36 in an overlaying, generally parallel relation to adjacent portions of the floor panels 50 of the two case sections 32, 34 when the case 30 is in the open position, as shown in FIG. 21, the coaction between the lugs 202–208 and the holes 168, 170 in the two hinge members 38, 40 further positioning the central portion 180 of the closure panel 36 in a blocking relation across the gaps 54 in the walls of the case sections 32, 34 as shown in FIG. 22. (As noted above, the runners 192, 194 on the closure panel 36 and the folds 82 on the floor panels 50 of the case sections 32, 34 contribute to such positioning of closure panel 36. However, such contribution is not essential; rather, the positioning can be accomplished solely with the lugs 202–208. The runners 192 and 194 and the folds 82 increase the support of the panel 36 across its whole length so that the lugs 202–208 will not have to bear the total burden of supporting the weight of any components inside the case in the closed position. Also the runners 192 and 194 and the folds 82 help eliminate rattling of the panel 36 when the case is closed. Also, the folds 82 and the runners 192 and 194 provide structural integrity to the portions of the panel 36 and the floor of the case which are fragile and may warp in some designs of the case. The folds 82 and the runners 192 and 194 can benefit the guiding of the panel 32 through its course of movement.

Figure 23:
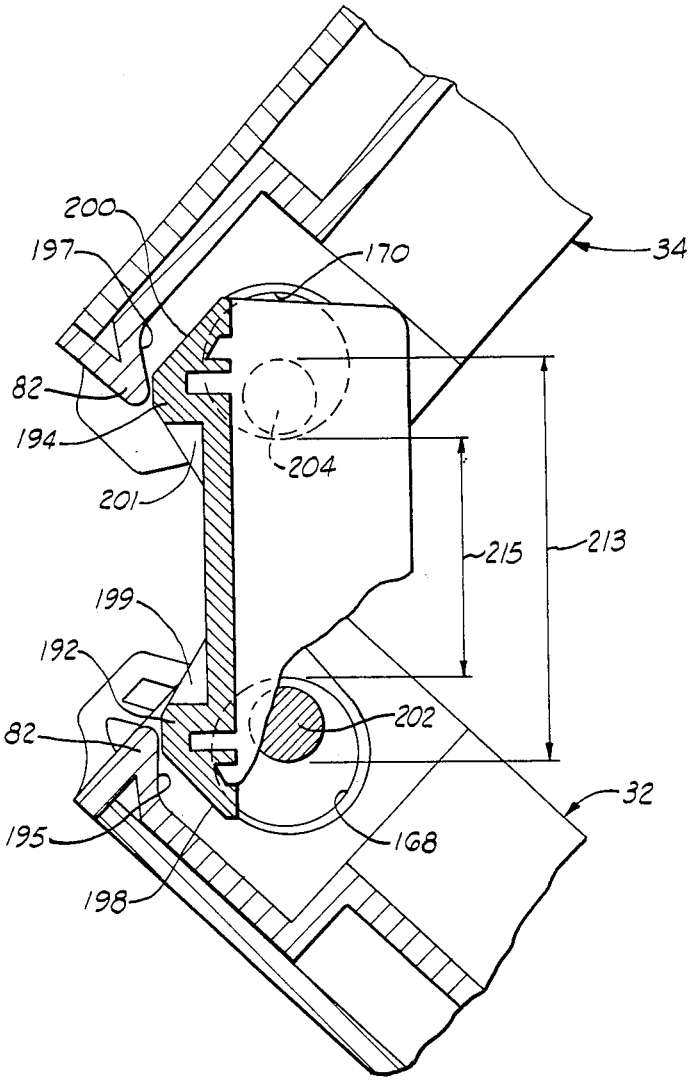
FIG. 23 is an enlarged partial cross section and partial cutaway in side elevation of portions of the case shown in FIG. 21 for a position of the case intermediate the open and closed positions thereof.

In order to provide the lugs 202–208 and the sockets 168, 170 in the hinge members 38, 40 with the above described panel positioning capabilities, while avoiding binding during movement of the case 30 between the open and closed positions thereof, a relationship that has been illustrated in FIG. 23 is established between the sizes of the lugs 202–208, the sizes of the sockets 168, 170 and the positions of the lugs and sockets on the closure panel 36 and the case sections 32 and 34 respectively. As the case sections 32 and 34 are moved between the positions the case sections 32 and 34 assume in the open and closed positions of the case 30, the distance between the sockets 168, 170 initially increases until the case sections 32 and 34 are disposed at a right angle as shown in FIG. 23. Thereafter, the distance between the sockets 168, 170 decreases so that, for either position of the case 30, open or closed, the centers of the sockets 168, 170 will have the common separation indicated by the distance 176 in FIG. 14 and by the distance 178 in FIG. 15. At the right angle position of the case sections shown in FIG. 23 the center-to-center separations of the sockets 168, 170 is the distance 213 which is the square root of 2 times the common distance 176, 178. (However, if the diameters of the lugs were smaller or the sockets were larger, these dimensions also would change.) The minimum spacing between the sockets 168, 170 in the right angle position of the case sections is the distance 213 less twice the common radius of the sockets 168, 170, such distance being indicated at 215 in FIG. 23. In order to prevent binding of the case 30, during opening and closing of the case 30, the radii of the sockets 168, 170 and of the lugs 202–208 are selected so that the separation 217 (FIG. 19) between the inside edges of the lugs 202 and 204, and the corresponding separation for the lugs 206 and 208, is slightly larger than the distance 215. One manner in which this criterion can be achieved is to make the diameters of the sockets 168, 170 half the distance 176 and 178 and to make the diameters of the lugs 202–208 half the diameters of the sockets 168, 170.

A comparison of FIG. 23 with FIGS. 21 and 22 illustrates an additional aspect of the invention that has been alluded to above. As has been noted the folds 82 on the floor panels 50 of the case sections 32, 34 are provided with angled surfaces 195, 197 that face the angled sides 198, 200 of the runners 192, 194 in the closed position of the case 30 and face the angled webs 199 and 201 in the open position of the case 30. During the movement of the case 30 between the open and closed positions, the angling of the surfaces 195, 197 and the sides and webs of the closure panel 36 causes the runners 192, 194 to slide along the surfaces 195 and 197 on the folds 80 so the folds 80 perform a camming function which smoothly guides the closure panel 36 between the two positions shown in FIGS. 2 and 22.

Figure 24:
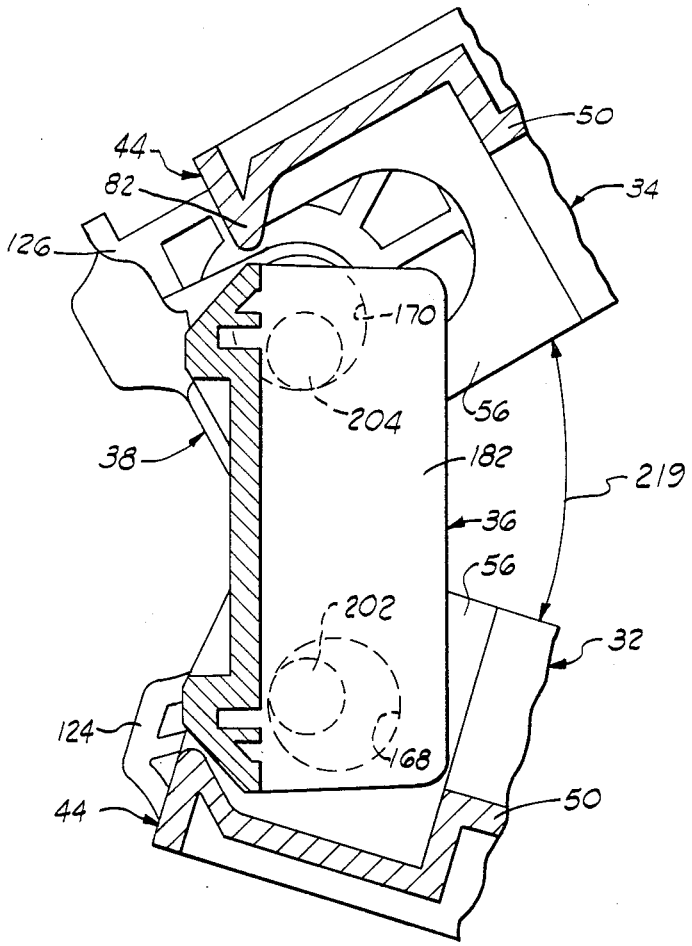
FIG. 24 is a partial cross section and partial cutaway of the portions of the case shown in FIGS. 21 and 22 illustrating the assembly of the case.

FIG. 24 illustrates a preferred mode of assembly of the case 30 utilizing the formation of the sockets y forming holes in hinge members which are subsequently incorporated into the walls 52 of the case sections 32, 34 and further utilizing the integral molding of the lugs 202–208 on the end plate portions 182, 184 of the closure panel 36. Specifically, FIG. 24 shows a lateral cross section of the closure panel 36, from inside the case 30, and the positions of the hinge member 38 and portions of the case sections 32, 34, adjacent the rear sides 44 thereof, during an intermediate stage in the assembly of the case 30. As indicated in such Figure, the preferred assembly of the case 30 is initiated by mounting the hinge members 38, 40 on the lugs 202–208 followed by inserting one hinge element of each hinge member into the channel in the wall of one of the case sections, as shown for the hinge element 124 of the hinge member 38 and the case section 32 in FIG. 23. Following the securing of the one hinge element of each hinge member in the wall of such case section, as discussed above with reference to FIGS. 14 and 15, the remaining hinge element of each hinge member is inserted into the channels in the walls of the other case section, as is indicated by the partial insertion of the hinge element 126 in the wall 56 of case section 34 in FIG. 23, and completing the securing of the hinge members 38, 40 to the case sections 32, 34 as discussed above. During the insertion of the hinge element 126, the lug 204 is positioned against the edge of the socket 170 farthest from the fold 82 on the case section 32 and the case sections 32 and 34 positioned at an angle, indicated at 219 in FIG. 24, to permit the closure panel 36 to clear the fold 82 on the case section 34 as has been illustrated. Following the mounting of the hinge members 38, 40 in closure panel 36 on the case sections 32, 34 and the inclusion of a handle on the case 30, as will now be described, the case 30 is completed by attaching the face panels 110, 112 as has been described above.

Returning now to FIG. 1, the case 30 is provided with a handle which is preferably comprised of a first handle member 216, mounted on the first case section 32, and a second handle member 218, mounted on the second case section 34. The handle members are identical and portions of each of the handle members are shaped to fit the niches, such as the niche 122 shown in FIG. 1, in the walls of the case sections 32, 34 so that the handle members 216, 218 can be disposed in the walls of the case sections 32 to further the aesthetically desirable, homogeneous character of the walls of the case sections 32, 34 as shown for the handle member 218 in FIG. 1 and as shown for both handle members 216, 218 in FIG. 2 Because of the identity of the handle members 216, 218, only one handle member need be described in detail and, for this purpose, the first handle member 216 has been illustrated in FIGS. 25–27.

As shown in these Figures, the handle member 216 generally comprises a grip portion 220 from which extend two connecting members 222, 224, having longitudinal slots, 226 and 228 respectively, formed therein. The purpose of the slots 226, 228 has been illustrated in FIG. 1, partially with reference to the first handle member 216 and partially with reference to the identical second handle member 218. Referring first to the first handle member 216 in FIG. 1, it can be seen that the grip portion 220 thereof is shaped to fit the niche 122 in the wall 52 of the case section 32 and, further, that the connecting members 222, 224 are positioned near the ends of the handle members so as to align with the apertures 74 and 76 through the webs 78 formed on the undersides of the case sections, such apertures communicating with the niches 122 in the case section walls as discussed above. Referring to the second handle member 218 in FIG. 1, it can then be seen that the slots 226, 228 receive the projections 70, 72 on the undersides of the case section floor panels so that, when the face panels 110, 112 are mounted on the case sections, the handle members 216, 218 will be secured to the case sections 32, 34 via the connecting members 222, 224 and lugs 70, 72, but will be free to slide on the case sections for movement of the grip portions 220 of the handle members 216, 218 into, and out of, the niches 122 in the case section walls. The handle members 216, 218 are constructed of a relatively flexible plastic material, such as polyethylene or polypropylene, so that the connecting members 222, 224 can be flexed after insertion through the apertures 74 and 76 to fit the slots 226, 228 over the projections 70, 72.

Figure 25:
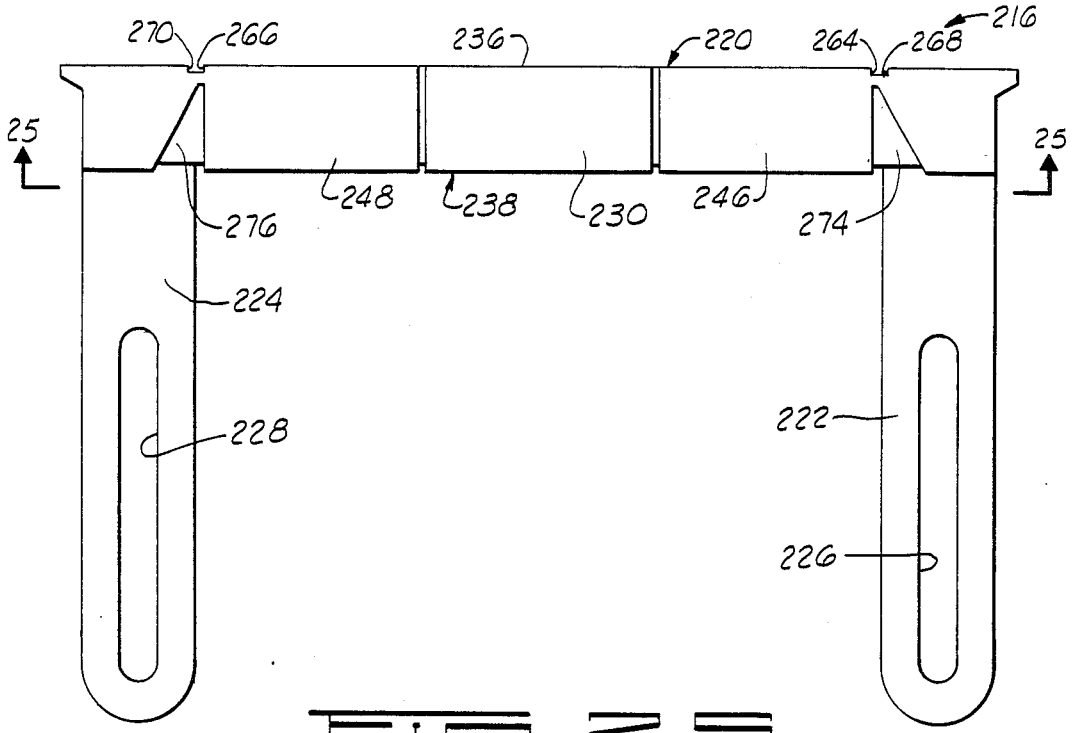
FIG. 25 is a plan view of one of the handle members of the case.
Figure 26:
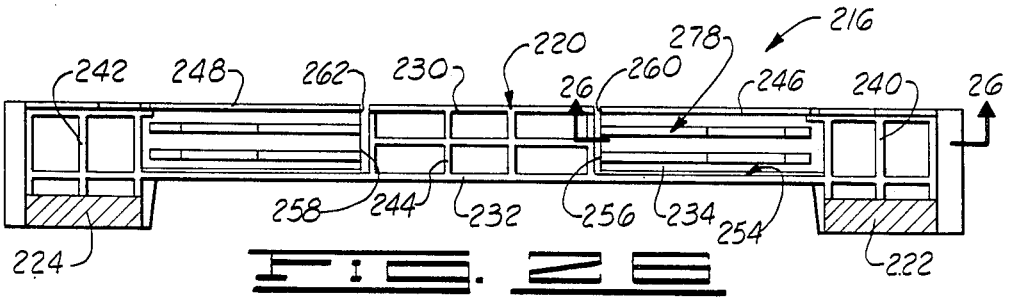
FIG. 26 is a cross section of the handle member taken along line 26—26 of FIG. 25.
Figure 27:
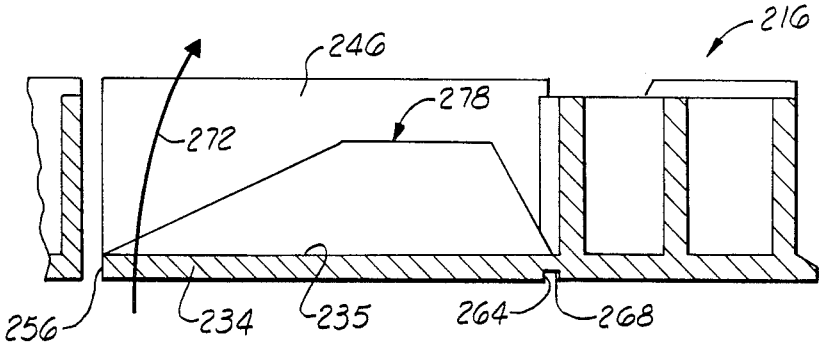
FIG. 27 is a cross section of a portion of the handle member taken along line 27—27 of FIG. 26.

Referring now to FIGS. 25–27, the grip portion 220 of the handle member 216 is preferably a molded box structure comprising an upper web 230, a parallel lower web 232, and a face web 234 attached to the upper and lower webs 230, 232 and extending across a forward side 236 of the grip portion 220 opposite a rear side 238 thereof from which the connecting members 222, 224 extend. Suitable reinforcing ribs can be disposed within the grip portion 220 as indicated at 240, 242 and 244 in FIG. 26.

As is shown in these Figures and in FIG. 1, the grip portions of the handle members are each comprised of at least one, and preferably two, pivotal levers, the levers of the grip portion 216 being numerically indicated at 246 and 248 in the drawings. To form the levers, cuts 250, 252 (FIG. 1) are formed through medial portions of the face web 234 along the upperside 254 (FIG. 26) of the lower web 232, cuts 256, 258 (FIG. 26) are formed through the face web 234 normal to the lower web 232 near the center of the grip portion 220, the cuts 256, 258 intersecting the cuts 250, 252 at the lower web 232, and cuts 260, 262 are formed through the upper web 230 to intersect the cuts 256, 258 and extend therefrom to the rear side 238 of the grip portion 220. In addition, at one end of each of the levers 246, 248 formed by the cuts 250, 252 and 256–262, such ends of the levers being designated by the numerals 264, 266 in FIG. 25, grooves 268, 270 are formed in the face web 234 to facilitate bending of the face web 234 for pivoting those portions of the grip portion 220 forming the levers 246, 248 toward the inner bulkhead 84 of the case section wall at such times that the grip portion is mounted in one of the niches 122. Such pivoting movement of the lever 246 has been indicated by the directional arrow 272 in FIG. 27 and, as noted above, the handle members 216 and 218 are formed of a relatively flexible plastic, thereby permitting such pivoting to occur. The pivoting of the levers 246, 248 is further facilitated by forming triangular depressions 274, 276 in portions of the upper web 230 adjacent the ends 264, 266 of the levers 246, 248 as indicated in FIG. 25, such portions of the upper web 230 being thickened as shown in FIG. 26 to underlie portions of the upper web 230 incorporated into the levers 246, 248. As is particularly shown in FIG. 27 for the lever 246, each lever 246, 248 is provided with an internal cam 278 extending along the internal face 235 of the web 234 to engage the inner bulkhead 84 of a wall in which the grip portion is mounted when the lever is pivoted in the direction 272 to force the fixed ends 264, 266 of the levers outwardly of the niche 122 and, accordingly, to force the grip portion 220 from the niche 122. (As shown, the cam 278 can conveniently be a pair of webs integrally molded into the handle member 216.) Thus, the grip portion 220 of the handle members 216, 218 can be disposed in the niches 122 in the case section walls and can be forced therefrom by pressing on portions of the levers 246, 248 adjacent the free ends thereof opposite the pivotable connections of the levers to remaining portions of the grip portions 220 at the ends 264, 266 of the levers.

As has been noted above, a contemplated application of the case 30 that has been particularly illustrated in the drawings is that of a folding game board capable of carrying pieces utilized in the play of the game. For such application, the case 30 further comprises a flexible mat 280 which is sized to fit within the combined walls of the two case sections 32, 34 when the case 30 is in the open position thereof, the mat 280 folding as shown in FIG. 1 when the case 30 is closed. The mat 280 enables the case 30 to be adapted to any particular board game by imprinting indicia thereon appropriate for the particular game to which the case 30 is adapted and can be attached to the case sections 32, 34 by gluing portions of the underside of the mat 280 to portions of the floor panels 50 of the case sections 32, 34 near the forward sides 42 of the case sections 32, 34 without interfering with the movement of the closure panel 36 when the case 30 is opened and closed. Conveniently, playing pieces for the game to which the case 30 is adapted can be carried in one or more bags 282 as indicated in FIG. 1, such bags each containing pieces to be used by one player to facilitate preparation of the case 30 for play.

OPERATION OF THE PREFERRED EMBODIMENT

Referring to FIGS. 1 and 2, it will be seen that the hinged connection of the case sections 32, 34 at the gaps 54 in the walls 52 of the case sections 32, 34 and, concurrently, at the upper edges 90 of the walls 52 will result in the case 30 having the form of an open-topped box when the case 30 is in the open position. That is, the rear sides 44 of the case sections 32, 34 will abut so that the floor panels 50 of the case sections 32, 34 are adjoined in a coplanar relation along the rear sides 44 of the case sections 32, 34 and the walls 52 of the two case sections coact to form a substantially unbroken wall extending completely about the combined floor panels of the two sections. Such construction and connection of the two case sections 32, 34, however, results in one end of the structure formed by the two case sections, such end being defined by the rear sides 44 of the two case sections 32, 34, being left open when the case 30 is subsequently closed because of the gaps in the walls of the case sections 32, 34 that provide free communication between the two case sections when the case is in the open position (See FIG. 1). The above described construction and mounting of the closure panel 36 closes such end of the case 30 in the closed position thereof without interfering with the free communication between the floor panels of the two case sections 32, 34 when the case 30 is opened as will now be discussed with particular reference to FIGS. 21 and 22. As can be seen in these Figures, the lugs 202, 204 on the end plate portion 182 of the closure panel 36 and the sockets 168, 170 formed in the walls of the case sections 32, 34 by the hinge member 38 (not numerically designated in FIG. 21) are spaced and sized, as described above, such that, in either position of the case 70, a line between the centers of the lugs will substantially coincide with a line between the centers of the sockets. A similar relation exists between the lugs 206, 208 on the end plate portion 184 of the closure panel 36 and the sockets in the walls of the case sections 32, 34 formed by the holes in the second hinge member 40. It is this coincidence of the lines between centers of the lugs and the sockets that causes the closure panel to take up a non-obstructing position when the case 30 is opened, so that free communication between the floor panels 50 of the two case sections 32, 34 exists in the open position of the case 30, and that causes the closure panel to take up a position across the gaps in the walls of the case sections 32, 34 when the case 30 is closed. In particular, as shown in FIG. 21, a line between the centers of the sockets 168, 170 will extend parallel to the floor panels 56 of the case sections 32, 34 when the case 30 is so that a line between centers of the lugs 202, 204 will similarly extend parallel to the floor panels 50 of the case sections 32, 34 in the open position of the case 30. The central portion 180 of the closure panel 36 is then positioned parallel to a line between centers of the lugs 202, 204 so that, in the open position of the case 30, the upper surface 190 of the central portion 180 of the closure panel 36 will extend parallel to the upper sides 56 of the floor panels 50 of both case sections 32, 34 and, via the recesses in the upper sides 56 of the floor panels 50 of the case sections 32, 34, can easily be made flush with the upper sides 56 of the floor panels 50.

Conversely, when the case 30 is closed such that the floor panel 50 of the case section 32 faces the floor panel 50 of the case section 34, as shown in FIG. 22, the sockets 168, 170 are pivoted to positions wherein a line connecting the centers of the sockets 168, 170 will be disposed generally perpendicularly to the floor panel 50 of each of the case sections 32, 34. Accordingly, because of the coincidence of a line connecting the centers of the lugs 202, 204 to a line connecting the centers of the sockets 168, 170, and the parallel disposition between the upper surface 190 of the central portion 180 of the closure panel 36 and the line between centers of the lugs 202, 204, the closure panel 36 will be pivoted to a position wherein the central portion 180 thereof is disposed substantially perpendicularly to the floor panels 50 of the case sections 32, 34 and will extend across the gaps 52 in the walls of the case sections 32, 34 at the rear sides of the case sections 32, 34.

When the case 30 is utilized as a case for games, it should be noted that many games require a partition separating two players and, in these instances, a panel may be attached to the inside surface 190 of the panel 36 extending a distance generally perpendicularly from the panel 36 and positioned so this panel is disposed within the case 30 in the closed position of the case 30. In the opened position of the case 30, this extra panel would extend a distance perpendicularly upwardly from the panel 36. The size of this extra panel would be dictated by the perimeter of the inside walls to allow the case 30 to close fully about this extra panel.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

We claim:

1. A case, comprising:

a first case section and a second case section, each case section comprising:

a floor panel having an upper side and an under side; and a wall attahced to the floor panel and extending partially thereabout to leave a gap through the wall at a rear side of the case section, said wall having an upper edge disposed a distance above the upper side of the floor panel;

said case sections including hinge means hingedly connecting the rear sides of the case sections at the upper edges of the walls and at the ends of the gaps through the walls for relative pivotation of the case sections to an open position of the case wherein the gap in the wall of the first case section is aligned with the gap in the wall of the second case section and the floor panels are adjoined in a substantially coplanar relation and for relative pivotation of the case sections to a closed position of the case wherein said floor panels are disposed in a spaced apart, facing relation said hinge means including at least one hinge element attached to each case section, at least a pair of hinge elements hinged together at a common point for pivoting throughout movement of the case sections from opened to closed, each of said hinge elements having an opposite end relative to said point of pivotation said opposite ends come into close proximity when said case is in the open position;

a closure panel comprising a laminar central portion; and mounting means, for mounting the closure panel on the section, for positioning the central portion of the closure panel in an overlaying, generally parallel relation to adjacent portions of the floor panels in the open position of the case and for positioning the central portion of the closure panel across the gaps in the walls in the closed position of the case.

2. The case of claim 1 wherein the closure panel further comprises two upwardly folded end plate portions with each end plate portion being disposed at one end of the central portion of the closure panel and being disposed generally adjacent one end of the gaps formed through the walls of the case sections, one end plate portion facing portions of the walls of both case sections at one end of the gaps formed through said walls and the other end plate portion facing portions of the walls of both case sections at the other end of the gaps formed through said walls; wherein a socket is formed in each portion of each wall faced by one of said end plate portions; and wherein said mounting means comprises a pair of projecting lugs on each end plate portion, one projecting lug on each end plate portion extending into the socket in the wall of the first case section and one projecting lug on each end plate portion extending into a socket in the wall of the second case section, the sockets and the end plate portions forming portions of the mounting means.

3. The case of claim 2 wherein the hinge means is characterized as comprising two hinge members, each hinge member disposed at one end of the gaps in the walls of the case sections and each hinge member comprising:

a first hinge element forming a portion of the wall of the first case section; and a second hinge element forming a portion of the wall of the second case section, the hinge elements being hingedly connected for providing the hinged connection between the two case sections; and wherein said sockets are formed in the hinge elements.

4. The case of claim 3 wherein each hinge element is characterized as having a rear side disposed along the rear side of the case section of which the hinge element is a part for disposition of the rear sides of the hinge elements comprising the hinge member in a facing relation in the closed position of the case and wherein the hinge elements comprising each hinge member are each characterized as having a recess and a projection formed on the rear faces thereof, the projection on the rear face of each hinge element of a hinge member extending into the recess in the rear side of the other hinge element of the hinge member in the open position of the case and the projections on the rear faces of both hinge elements of a hinge member protruding from the rear sides of the case sections in the closed position of the case.

5. The case of claim 1 wherein the hinge means is characterized as comprising two hinge members, each hinge member disposed at one end of the gaps in the walls of the two case sections, each hinge member comprising:

a first hinge element forming a portion of the wall of the first case section; and a second hinge member forming a portion of the wall of the second case section, the hinge elements of each hinge member being hingedly connected for providing the hinged connection between the two sections of the case.

6. The case of claim 5 wherein each hinge element is characterized as having a rear side disposed along the rear side of the case section of which the element is a part for disposition of the rear sides of the hinge elements comprising a hinged member and in a facing relation in the closed position of the case and wherein the hinge elements each have a recess and a projection formed on the rear faces thereof, the projection on the rear face of each hinge element of a hinge member extending into the recess of the other hinge element of the hinge member in the open position of the case and the projections on the rear faces of both hinge elements of each hinge member protruding from the rear sides of the case sections in the closed position of the case.

7. The case of claim 1 further comprising a handle for carrying the case, said handle comprising:

a first handle member mounted on the first case section; and a second handle member mounted on the second case section, each handle member having a grip portion and the handle members positioned on the case sections for positioning the grip portion of the first handle member alongside the grip portion of the second handle member in the closed position of the case.

8. A case, comprising:

a first case section and a second case section, each case section comprising:

a floor panel having an upper side and an under side; and a wall attached to the floor panel and extending partially thereabout to leave a gap through the wall at a rear side of the case section, said wall having an upper edge disposed a distance above the upper side of the floor panel, wherein the rear sides of the case section are hingedly connected at the upper edges of the walls and at the upper ends of the gaps through the walls for relative pivotation of the case sections to an open position of the case wherein the gap in the wall of the first case section is aligned with the gap in the wall of the second case section and the floor panels are adjoined in a substantially coplanar relationship and for relative pivotation of the case sections to a closed position of the case wherein said floor panels are disposed in a spaced apart, facing relationship;

a closure panel comprising a laminar central portion, the closure panel comprising two upwardly folded end plate portions with each end plate portion being disposed at one end of the central portion of the closure panel and being disposed generally adjacent one end of the gaps formed through the walls of the case sections, one end plate portion facing portions of the wall of both case sections at one end of the gaps formed through said walls and the other end plate portion facing portions of the walls of both case sections at the other end of the gaps formed through said walls, a socket being formed in each wall faced by one of said end plate portions; and means, supporting the closure panel on the sections, for positioning the central portion of the closure panel in an overlaying, generally parallel relationship to adjacent portions of the floor panels in the open position of the case and for positioning the central portion of the closure panel across the gaps in the walls in the closed position of the case, portions of the walls faced by the end plate portions being recessed to receive the end plate portions therein and portions of the floor panels overlaying by the central portion of the closure panel being recessed to receive said central portion therein in the opened position of the case, said means comprising:

a pair of projecting lugs on each end plate portion, one projecting lug on each end plate portion extending into the socket in the wall of the first case section and one projecting lug on each end plate portion extending into the socket in the wall of the second case section.

9. The case of claim 8 the central portion of the closure panel is characterized as having an under side facing the floor panels of the case sections in the open position of the case and wherein the floor panel of each case section has a lip formed thereon along the rear side of the case section, said lip projecting from the floor panel to extend alongside laterally disposed portions of the under side of the central portion of the closure panel in the closed position of the case.

10. The case of claim 8 further comprising means for forming a game board positionable within the case sections to overlay the floor panels and the central portion of the closure panel in the open position of the case, the walls of each case section cooperating to extend generally about said means in the open position of the case.

11. A case, comprising:

a first case section and a second case section, each case section comprising:

a floor panel having an upper side and an under side; and a wall attached to the floor panel and extending partially thereabout to leave a gap through the wall at the rear side of the case section, said wall having an upper edge disposed a distance above the upper side of the floor panel, wherein the rear sides of the case sections are hingedly connected at the upper edges of the walls and at the ends of the gaps through the walls for relative pivotation of the case sections to an opened position of the case wherein the gap in the wall of the first case section is aligned with the gap in the wall of the second case section and the floor panels are ajoined in a substantially coplanar relationship and for relative pivotation of the case sections to a closed position of the case wherein said floor panels are disposed in a spaced apart, facing relationship, the wall of each case section comprising a panel folded into an inner bulkhead attached to the floor panel of the section and extending thereabout between the ends of the gap in the wall, an outer bulkhead extending in a substantially parallel relationship about the inner bulkhead, and a connecting bulkhead connecting the inner and the outer bulkheads at the upper edge of the wall so as to form a channel within the wall between the inner and the outer bulkheads thereof; and a closure panel comprising a laminar central portion, the closure panel comprising two upwardly folded end plate portions with each end plate portion being disposed at one end of the central portion of the closure panel and being disposed generally adjacent one end of the gaps formed through the walls of the case sections, one end plate facing portions of the walls of both case sections at one end of the gaps formed through said walls and the other end plate portion facing portions of the walls of both case sections at the other end of the gaps formed through said walls, a socket being formed in each portion of each wall faced by one of said end plate portions; and means, supporting the closure panel on the case sections, for positioning the central portion of the closure panel in an overlaying, generally parallel relationship to adjacent portions of the floor panels in the opened position of the case and for positioning the central portion of the closure panel across the gaps in the walls in the closed position of the case, said means comprising:

a pair of projecting lugs on each end plate portion, one projecting lug on each end plate portion extending into the socket in the wall of the first case section and one projecting lug on each end plate portion extending into a socket in the wall of the second case section;

two hinge members, each member disposed at one end of the gaps in the walls of the case sections and each hinge member comprising:

a first hinge element forming a portion of the wall of the first case section; and a second hinge element forming a portion of the wall of the second case section, the hinge elements being hingedly connected for providing the hinge connection between the two case sections, the sockets being formed in the hinge elements, the first hinge elements of the hinge members being disposed in the channel formed in the wall of the first case section and the second hinge elements of the hinge members being disposed in the channel formed in the wall of the second case section.

12. The case of claim 11 wherein each floor panel is characterized as having a plurality of reinforcing ribs formed on the underside thereof and wherein each case section further comprises a face panel attached to the outer bulkhead of the wall of the case section to overlay the reinforcing ribs on the underside of the floor panel of the case section.

13. The case of claim 11 further comprising means mounted on portions of the connecting bulkheads of the walls of the first and second case sections opposite the gaps in said walls for magnetically holding the case in the closed position thereof.

14. A case, comprising:

a first case section and a second case section, each case section comprising:

a floor panel having an upper side and an under side; and a wall attached to the floor panel and extending partially thereabout to leave a gap through the wall at a rear side of the case section, said wall having an upper edge disposed a distance above the upper side of the floor panel, wherein the rear sides of the case section are hingedly connected at the upper edges of the walls and at the ends of the gaps through the walls for relative pivotation of the case sections to an opened position of the case wherein the gap in the wall of the first case section is aligned with the gap in the wall of the second case section and the floor panels are ajoined in a substantially coplanar relationship and for relative pivotation of the case sections to a closed position of the case wherein said floor panels are disposed in a spaced apart, facing relationship;

a closure panel comprising a laminar portion, said closure panel comprising:

two upwardly folded end plate portions disposed at the end of the central portion thereof adjacent the ends of the gaps through the walls of the case sections, one end plate portion facing portions of the walls of both case sections at one of said gaps in said walls and the other end plate portion facing portions of the walls of both case sections at the other end of said gaps in said walls; and means, supporting the closure panel on the sections, for positioning the central portion of the closure panel in an overlaying, generally parallel relation to adjacent portion of the floor panels in the opened position of the case and for positioning the central portion of the closure panel across the gaps in the walls in the closed position of the case, portions of the walls faced by the end plate portions being recessed to receive the end plates therein and portions of the floor panels overlaying by the central portion of the closure panel being recessed to receive the central portion of the closure panel therein the opened position of the case.

15. The case of claim 14 further comprising means for forming a game board positionable within the case sections to overlay the floor panels and the central portion of the closure panels in the open position of the case, the walls of each case section cooperating to extend generally about said means in the open position of the case.

16. The case of claim 15 the wall of each case section comprises a panel folded into an inner bulkhead attached to the floor panel of the case section and extending thereabout between the ends of the gap in the wall, an outer bulkhead extending in substantially parallel relation about the inner bulkhead, and a connecting bulkhead connecting the inner and outer bulkheads at the upper edge of the wall; wherein each floor panel is characterized as having a plurality of reinforcing ribs formed on the underside thereof; and wherein each case section further comprises a face panel attached to the outer bulkhead of the wall of the case section to overlay the reinforcing ribs on the underside of the floor panel of the case section.

17. The case of claim 16 wherein the connecting bulkhead of the wall of the second case section is positioned to abut and extend along the connecting bulkhead of the first case section in the closed position of the case and wherein each case section further comprises a magnet and a striker plate formed of a magnetic material mounted in the connecting bulkhead of the case section, the magnet of the first case section aligning with the striker plate of the second case section and the magnet of the second case section aligning with the striker plate of the first case section in the closed position of the case for releasably holding the case in the closed position thereof.

18. The case of claim 16 further comprising a handle for carrying the case, said handle comprising:

a first handle member mounted on the first case section; and a second handle member mounted on the second case section, each handle member having a grip portion and the handle members positioned on the case sections for positioning the grip portion of the first handle member alongside the grip portion of the second handle member in the closed position of the case.

19. The case of claim 18 wherein portions of the walls of the case sections are provided with niches for receiving the grip portions of the handle members therein; wherein the handle members are slideably mounted on the case sections for sliding movement of the grip portions into and out of said niches in the walls of the case sections; and wherein each grip portion of each handle member comprises a lever pivotally mounted at one end thereof to remaining portions of the grip portion for movement of the other end of the lever on an arc intersecting the wall of the case section upon which the handle member is mounted, said lever having a cam engageable with the wall of a case section for pivoting remaining portions of the grip portion outwardly of the niche wherein the grip portion is disposed via pressure exerted on said other end of the lever.

20. A case, comprising:

a first case section and a second case section, each case section comprising:

a floor panel having an upper side and an under side; and a wall attached to the floor panel and extending partially thereabout to leave a gap through the wall at a rear side of the case section, said wall having an uper edge disposed a distance above the upper side of the floor panel, wherein the rear sides of the case sections are hingedly connected at the upper edges of the walls and at the ends of the gaps through the walls for relative pivotation of the case sections to an open position of the case wherein the gap in the wall of the first case section is aligned with the gap in the wall of the second case section and the floor panels are adjoined in a substantially coplanar relation and for relative pivotation of the case sections to a closed position of the case wherein said floor panels are disposed in a spaced apart, facing relation;

a closure panel comprising a laminar central portion; and means, supporting the closure panel on the sections, for positioning the central portion of the closure panel in an overlaying, generally parallel relation to adjacent portions of the floor panels in the open position of the case and for positioning the central portion of the closure panel across the gaps in the walls in the closed position of the case; and a handle for carrying the case, said handle comprising:

a first handle member mounted on the first case section; and a second handle member mounted on the second case section, each handle member having a grip portion and the handle members being positioned on the case sections for positioning the grip portion of the first handle member along side the grip portion of the second handle member in the closed position of the case, portions of the walls of the case sections being provided with niches for receiving the grip portions of the handle members therein, the handle members being slidably mounted on the case sections for sliding movement of the grip portions into and out of said niches in the walls of the case sections, each grip portion of each handle member comprising a lever pivotally mounted at one end thereof to the remaining portions of the grip portion for movement of the other end of the lever on an arc intersecting the wall of the case section upon which the handle member is mounted, said lever having a cam engagable with the wall of the case section for pivoting remaining portions of the grip portion outwardly of the niche wherein the grip portion is disposed via pressure exerted on said other end of the lever.

* * * * *